US007702274B2

(12) United States Patent
Kamei et al.

(10) Patent No.: US 7,702,274 B2
(45) Date of Patent: Apr. 20, 2010

(54) IMAGE FORMING APPARATUS WITH FIXING FLUID APPLYING SECTION

(75) Inventors: Yukikazu Kamei, Chiba (JP); Hiroshi Doshoda, Chiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 461 days.

(21) Appl. No.: 11/730,655

(22) Filed: Apr. 3, 2007

(65) Prior Publication Data

US 2007/0231027 A1 Oct. 4, 2007

(30) Foreign Application Priority Data

Apr. 3, 2006 (JP) ..... P2006-102496

(51) Int. Cl.
*G03G 15/20* (2006.01)

(52) U.S. Cl. ..... 399/340; 399/329

(58) Field of Classification Search ..... 399/341, 399/320, 324, 340, 329
See application file for complete search history.

(56) References Cited

U.S. PATENT DOCUMENTS 5,361,084 A 11/1994 Paton et al.
2006/0133866 A1* 6/2006 Asakura et al. ..... 399/320

FOREIGN PATENT DOCUMENTS

JP 8-207319 A 8/1996
JP 2004-284306 A 10/2004

* cited by examiner

*Primary Examiner*—Susan S Lee
(74) *Attorney, Agent, or Firm*—Nixon & Vanderhye, P.C.

(57) ABSTRACT

Provided is an image forming apparatus jointly using both a heat fixing method and a wet fixing method wherein bleeding and aggregation of a toner, curl and creases of a recording medium, and the like do not occur when a fixing fluid is applied to a toner image. Power consumption is significantly lower than that of a past heat fixing method. A high-quality image is stably formed. The image forming apparatus includes a toner image forming section, an intermediate transfer section, a secondary transfer section, a fixing fluid applying section, a fixing section having a driving roller in which a heating section is built, and a conveying section. There is provided a fixing fluid amount controlling section which controls a fixing fluid amount applied to a toner image on a recording medium by the fixing fluid applying section so as to increase as the recording medium approaches the fixing section.

7 Claims, 10 Drawing Sheets

IMAGE FORMING APPARATUS WITH FIXING FLUID APPLYING SECTION

CROSS-REFERENCE TO RELATED APPLICATION

This application claims priority to Japanese Patent Application No. 2006-102496, which was filed on Apr. 3, 2006, the contents of which, are incorporated herein by reference, in their entirety.

BACKGROUND OF THE INVENTION

1. Field of the Invention

The present invention relates to an image forming apparatus.

2. Description of the Related Art

Conventionally, in an image forming apparatus such as a photocopier, a printer, and a facsimile in an electrophotographic recording system, a photoreceptor drum having a photosensitive layer on a surface thereof is used, an electrostatic latent image is formed by exposing a charged surface of the photoreceptor drum to signal light according to signal information to form an electrostatic latent image, a toner image is formed by supplying a toner and developing the electrostatic latent image, the toner image is transferred onto a recording medium, and then the toner image is fixed to the recording medium, whereby an image is formed on the recording medium. In the electrophotographic recording system, a toner used for forming the image on the recording medium is generally a granular substance obtained by dispersing a colorant, a release agent, a charge control agent, and the like in binder resins and finely granulating the resultant product. A heat fixing method, a wet fixing method, and the like are used for fixing the toner to the recording medium. Among these methods, since the heat fixing method is simple in configuration of an apparatus and easily and reliably fixes the toner image to the recording medium, the heat fixing method is mostly used in recent.

According to heat fixing method, for example, there is used a fixing section including a fixing roller heated at a temperature at which the toner is molten and a pressing roller provided so as to press the fixing roller and to be joined thereto. The recording medium on which a toner image is transferred (hereinafter referred to as "toner image transferred recording medium") passes through a pressure-contact portion (fixing nip portion) between the fixing roller and the pressing roller and thus the toner image is fixed to the recording medium. The heat fixing method is mainstream in the recent image forming apparatus. However, since the binder resin of the toner should be heated at a high temperature of 100° C. or more capable of being softened or molten, power consumption is large and it may be necessary to be improved in a point of view of energy-saving. In addition, when the fixing roller does not rise to a predetermined temperature, the fixation is not preformed. Accordingly, a time arriving at a predetermined temperature, that is, a warm-up time, is required.

Further, in order to fix a multicolored toner image to the recording medium, more time is required than a single colored toner image. Since the inside of the image forming apparatus is at a high temperature and thus heat resistance of a constituent provided in the inside of the image forming apparatus and heat insulating property should increase, the material cost increases. In addition, a higher output heating section is required than a heating section in the past in accompaniment with a high speed of the image forming speed in recent. However, when the output of the heating section becomes higher, the image forming apparatus becomes larger. This is not preferable in term of the present situation where the image forming apparatus becomes smaller.

Meanwhile, in the wet fixing method, a fixing fluid including water and liquid which is soluble and dispersible in water and which softens and swells the toner are used so as to fix the toner image to the recording medium. According to the wet fixing method, the toner constituting the toner image is softened or swelled by applying the fixing fluid to the toner image and the toner image is fixed to the recording medium by transferring the toner image formed of the softened or swelled toner to the recording medium under pressure. Since power consumption in the wet fixing method is very lower than that in the heat fixing method, the wet fixing method is a useful method in term of energy-saving. Also, in term of fixing time of the multicolored toner image, since a great amount of heat is not required, the time can be shortened more than the heat fixing method. Accordingly, by using the wet fixing method with the heat fixing method, it has been proposed the image forming speed becomes higher without decrease in consumption and increase in size of the image forming apparatus.

For example, there is provided an image forming apparatus including a toner image forming section, a transfer section, a fixing section, a conveying section, and a fixing fluid applying section. Herein, the toner image forming section forms the toner image according to image information.

The transfer section transfers the toner image formed by the toner image forming section to the recording medium. The fixing section fixes the toner image to the recording medium by heating and pressing the toner image transferred recording medium. The conveying section conveys the toner image transferred recording medium to the fixing section. The fixing fluid applying section applies the fixing fluid to the unfixed toner image while the toner image is fixed after the transfer, thereby softening and/or swelling the toner constituting the toner image (for example, refer to Japanese Unexamined Patent Publication JP-A 2004-284306). In an image forming apparatus of JP-A2004-284306, a fixing fluid section applies a fixing fluid to a toner image before fixation and softens and swells the toner image. Accordingly, heating temperature at the time of fixing is decreased, power consumption is decreased, and thus an image forming speed may become higher.

In the image forming apparatus suggested in JP-A 2004-284306, the fixing process is hardly performed with the toner image transferred to the recording medium and the fixing fluid is applied in non-contact to the toner image which is in a state without adhesive power to the recording medium using an electrostatic ink jet recording head or the like. In this configuration, bleeding of the toner, aggregation of the toner, and unevenness of a toner image caused thereby when droplets of the fixing fluid are fixed to the toner image. Accordingly, image reproducibility and image quality may decrease. For this reason, in the image forming apparatus of JP-A 2004-284306, it is proposed that the toner image transferred to the recording medium is once heated, the toner constituting the toner image is molten and fixed to the recording medium to some extent, and then the fixing fluid is applied. In this case, since the toner should be molten and fixed to the recording medium under non-pressure, the toner should be heated at a very high temperature for melting and fixing the toner. The heating temperature is influenced by conditions such as transfer speed. However, for example, when the transfer speed is 200 mm/sec in line, a temperature in the range of 140 to 160° C. is needed. Accordingly, in the image forming apparatus of JP-A2004-284306, it is difficult to extremely reduce power consumption. In addition, when the fixing fluid is applied to the toner image on the recording medium, the recording medium absorbs the fixing fluid, whereby curl and creases may occur.

SUMMARY OF THE INVENTION

An object of the invention is to provide an image forming apparatus using both the heat fixing method and the wet fixing method in which bleeding of toner, aggregation of toner, unevenness of a toner image caused thereby, and curling or wrinkling of a recording medium do not occur in applying a fixing fluid to a toner image and power consumption of which is very lower than that of a conventional apparatus using a heat fixing method.

The invention provides an image forming apparatus comprising:

a toner image forming section which forms a toner image according to image information;

a transfer section which transfers the toner image on a recording medium formed by the toner image forming section;

a fixing section which fixes the toner image transferred on the recording medium by the transfer section;

a conveying section which conveys the recording medium on which the toner image is transferred from the transfer section to the fixing section;

a fixing fluid applying section which is placed between the transfer section and the fixing section and applies to the toner image on the recording medium a fixing fluid which softens and/or swells a toner, after the toner image is transferred on the recording medium by the transfer section, which recording medium is conveyed to the fixing section by the conveying section; and a fixing fluid amount controlling section which controls an amount of the fixing fluid applied to the toner image on the recording medium by the fixing fluid applying section so as to increase as the recording medium approaches the fixing section.

According to the invention, an image forming apparatus comprises a toner image forming section which forms a toner image, a transfer section which transfers the toner image to a recording medium, a fixing section which fixes the toner image on the recording medium, a conveying section which conveys the recording medium on which the toner image is transferred to the fixing section, a fixing fluid applying section which applies a fixing fluid to the toner image on the recording medium conveyed by the conveying section, and a fixing fluid amount controlling section. By the fixing fluid amount controlling section, the fixing fluid amount applied to the toner image on the recording medium is controlled so as to increase as the recording medium approaches the fixing section. According to the image forming apparatus, when the fixing fluid is applied to the non-fixed toner image, the fixing fluid amount is set to be relatively low in an initial step in the direction of conveying the unfixed toner image transferred recording medium from the transfer section toward the unfixing section is transferred and to relatively increase the applying amount of the fixing fluid as the recording medium approaches the fixing section, whereby it is suppressed that bleeding and aggregation of the toner and unevenness of an image occur caused thereby. In addition, in the initial step of applying the fixing fluid, since a relatively small amount of a fixing fluid is applied, the fixing fluid is efficiently absorbed into only toner, the toner is swelled and softened, and thus the toner may easily absorb the fixing fluid. In this state, even when relatively much larger amount of the fixing fluid is applied, the toner absorbs substantially full amount of the fixing fluid and thus the fixing fluid is not attached to the recording medium. Accordingly, it can be prevented that curl and creases occur to the recording medium. By the applying method, the toner constituting the toner image is sufficiently swelled and softened without scattering in the toner image. Accordingly, when the toner image is fixed to the recording medium, it is not required to be heated at 100° C. or more. Consequently, the power consumption extremely can decrease and the high-quality image can be stably formed.

In the invention, it is preferable that the fixing fluid applying section includes a fixing fluid reservoir which stores the fixing fluid therein, a droplet supplying section having fixing fluid spray nozzles from which the fixing fluid is supplied to the toner image on the recording medium, and a supply tube through which the fixing fluid in the fixing fluid reservoir is supplied to the droplet supplying section.

According to the invention, since droplets of a fixing fluid with a relatively small diameter are supplied from the spray nozzles of the droplet supplying section using the fixing fluid applying section including a fixing fluid reservoir which stores the fixing fluid, a droplet supplying section having fixing fluid spray nozzles from which the fixing fluid is supplied to the toner image on the recording medium, and a supply tube through which the fixing fluid in the fixing fluid reservoir is supplied to the droplet supplying section, it can be efficiently prevented bleeding and aggregation of the toner in applying the fixing fluid. Further, since the fixing fluid applying section has a simple structure, there is an advantage excellent for long service life.

In the invention, it is preferable that a spray nozzle pitch is lower than an image resolution of the toner image forming section.

In the invention, it is preferable that the spray nozzle pitch is 150 dpi or less.

According to the invention, since small droplets of the fixing fluid are supplied to be in the form substantially corresponding to the distribution of the toner in the toner image forming section by setting the spray nozzle pitch of the droplet supplying section to be preferably lower than the image resolution in the toner image forming section (more preferably, lower than 150 dpi), the fixing fluid spreads on the whole toner image and thus all toner constituting the toner image is uniformly swelled and softened. Accordingly, the high-quality image with good image reproducibility can be stably formed.

In the invention, it is preferable that the fixing fluid amount controlling section controls the amount of the fixing fluid applied from the fixing fluid applying section to the toner image on the recording medium according to the image information.

According to the invention, since the fixing fluid amount controlling section controls the applying amount of the fixing fluid from the fixing fluid applying section to the toner image on the recording medium according to the image information, the fixing fluid can be applied with the amount corresponding to the attachment amount of the toner in the toner image. That is, the applying amount of the fixing fluid can be set to be large in a part where the attachment amount of the toner is large and to be small in a part where the attachment amount of the toner is small. Accordingly, the fixing fluid can be efficiently used without waste and the toner is sufficiently swelled and softened by the fixing fluid. It is further prevented that curl, crease, and the like occur on the recording medium by absorbing the fixing fluid.

In the invention, it is preferable that the image forming apparatus further comprises a heating section for heating the recording medium on which the toner image is transferred, the heating section being provided upstream of a position of applying the fixing fluid to the toner image on the recording medium by the fixing fluid applying section in a direction of conveying the recording medium on which the toner image is transferred by the conveying section.

According to the invention, since a heating section is provided in the upper side than a position of applying the fixing fluid to the toner image on the recording medium by the fixing fluid applying section in a direction of conveying the recording medium on which the toner image is transferred by the conveying section, the fixing fluid is infiltrated into the toner at higher speed and thus a solvent component (mainly, water) other than effective components (components which swell and soften the toner) in the fixing fluid is rapidly evaporated. Accordingly, the toner is further reliably swelled and softened and it is further reliably prevented that curl and creases occur in the recording medium.

In the invention, it is preferable that the fixing section includes a driving roller, a pressing roller, a conveyer belt which is tightly suspended by the driving roller and the pressing roller and which is formed in a loop shape, for conveying the recording medium on which the toner image is transferred, and a heating section provided inside the driving roller and/or the pressing roller.

According to the invention, since the fixing fluid can be applied under heating using the fixing section including the driving roller, the pressing roller, the endless belt which is tightly suspended by the driving roller and the pressing roller and which is formed in the loop shape, for conveying the recording medium on which the toner image is transferred, and the heating section provided inside the driving roller and/or the pressing roller, the fixing fluid is infiltrated to the toner at a higher speed. Accordingly, solvent component other than effective component in the fixing fluid is rapidly evaporated, the toner is further reliably swelled and softened, and it is further reliably prevented that curl and creases occur in the recording medium.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
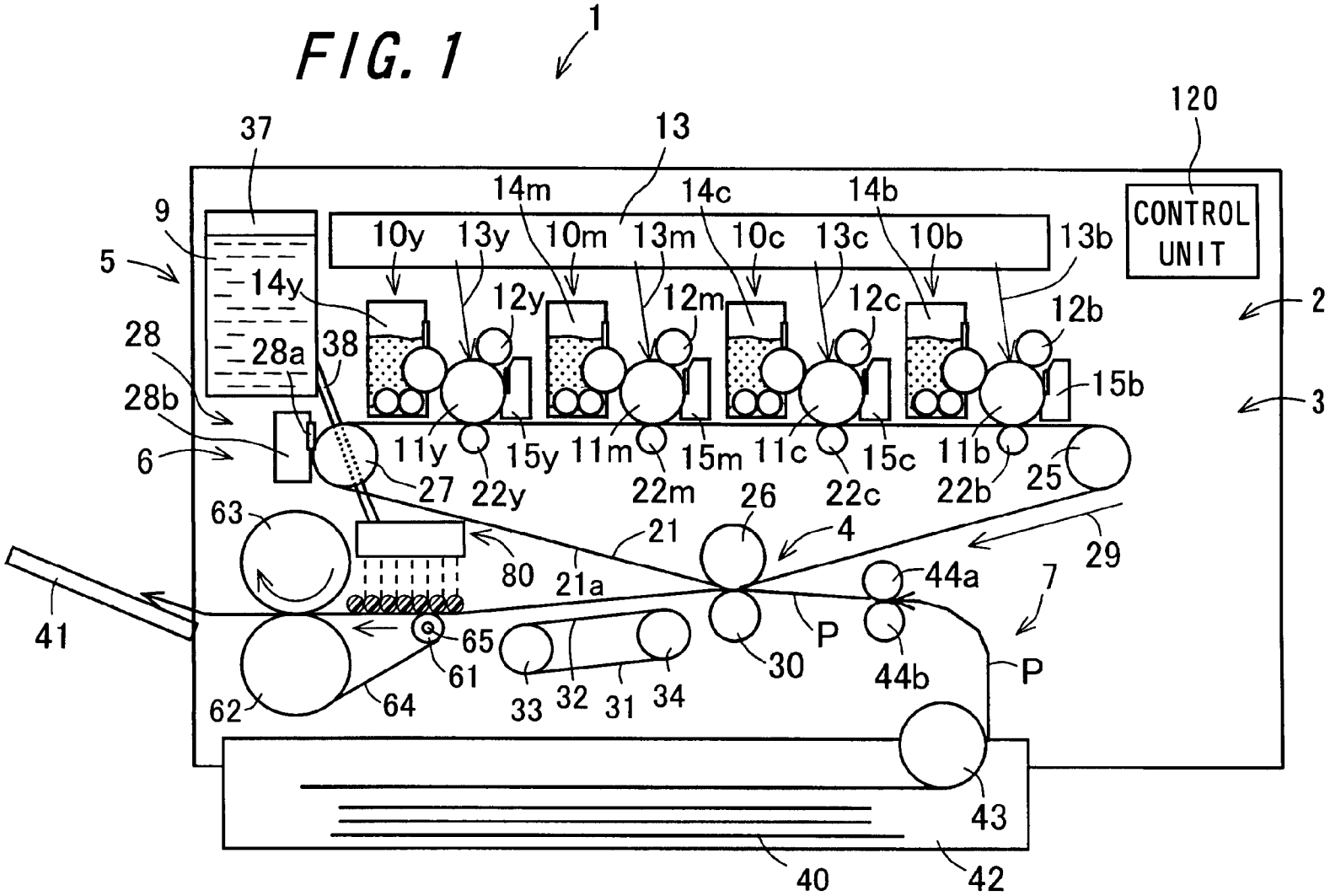
FIG. 1 is a sectional view schematically illustrating an image forming apparatus according to a first embodiment of the invention.

Now referring to the drawings, preferred embodiments of the invention are described below.

Figure 2:
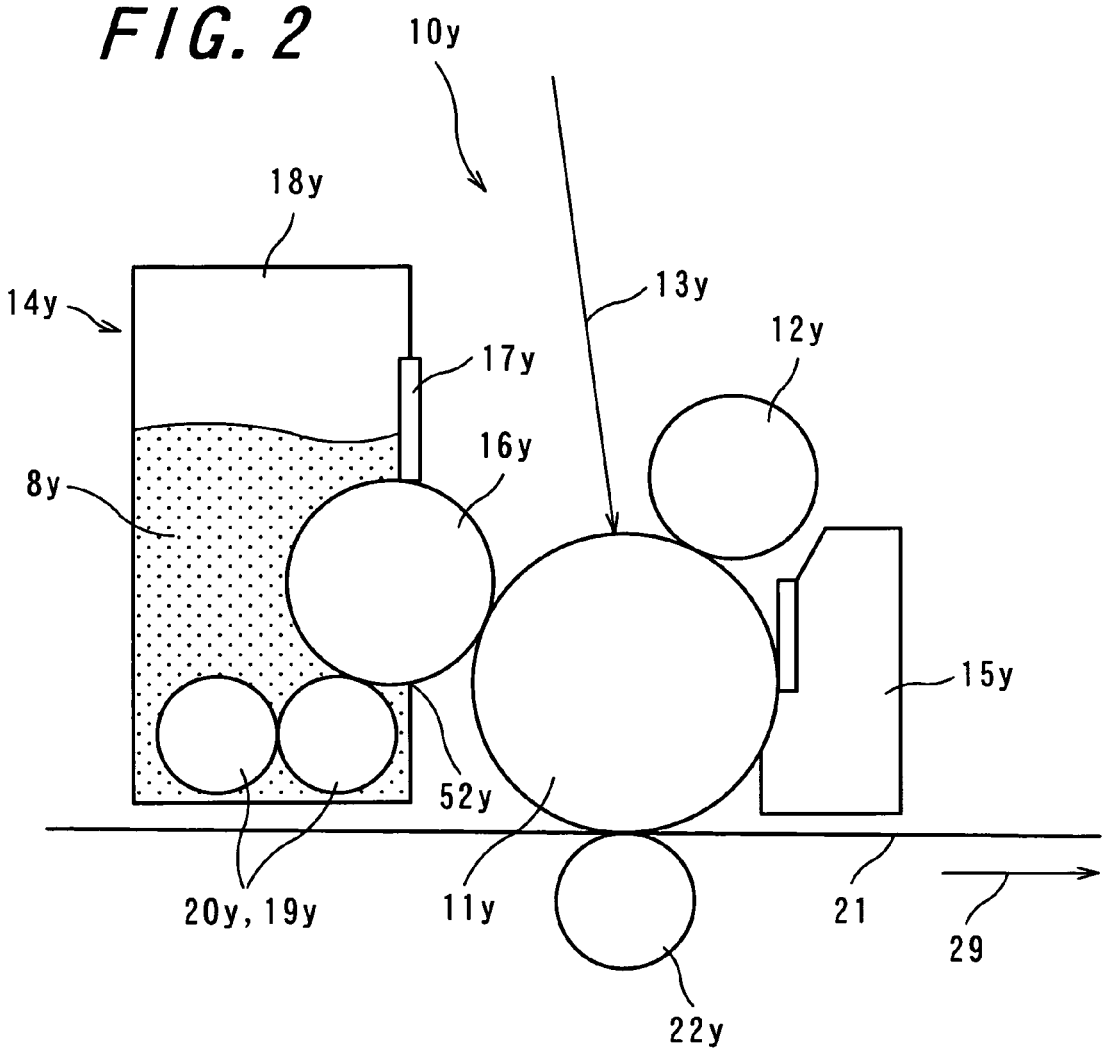
FIG. 2 is an enlarged sectional view illustrating a essential portion of the image forming apparatus shown in FIG. 1.
Figure 3:
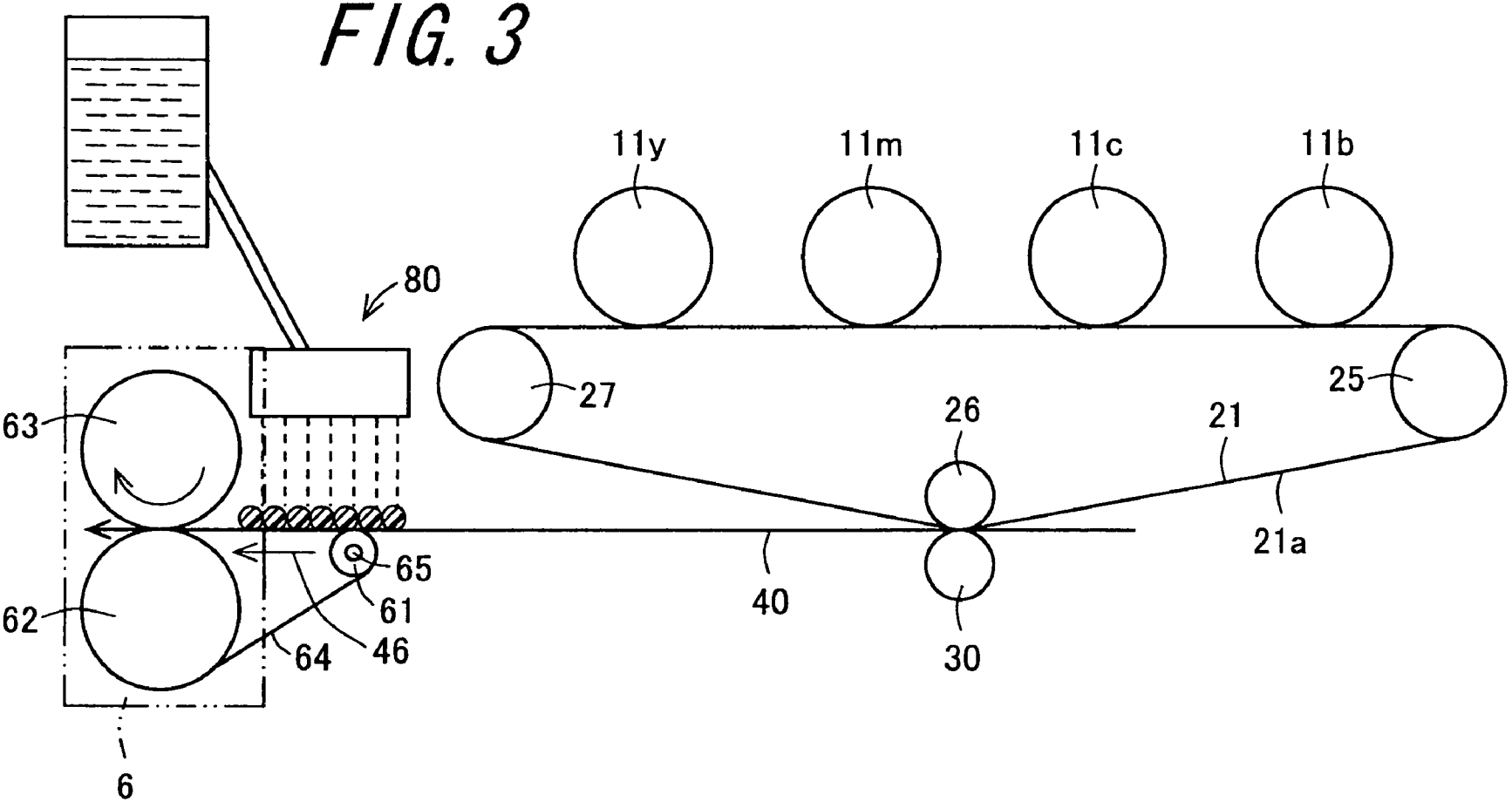
FIG. 3 is an enlarged sectional view illustrating essential portions of the image forming apparatus showing in FIG. 1.

FIG. 1 is a sectional view schematically illustrating an image forming apparatus 1 according to a first embodiment of the invention. FIG. 2 is an enlarged sectional view illustrating a essential portion (a toner image forming section 2) of the image forming apparatus 1 shown in FIG. 1. FIG. 3 is an enlarged sectional view illustrating essential portions of the image forming apparatus 1 showing in FIG. 1 (a fixing fluid applying section 5 and fixing section 6). In FIG. 3, a conveying section 31 is not shown. An image forming apparatus 1 is a tandem electrophotography image forming apparatus in which toner image with four colors of yellow, magenta, cyan, and black is sequentially transferred and overlaid. The image forming apparatus 1 includes a toner image forming section 2, an intermediate transfer section 3, a secondary transfer section 4, a conveying section 31, a fixing fluid applying section 5, a fixing section 6, a recording medium supplying section 7, and a fixing fluid amount controlling section (not shown).

The toner image forming section 2 includes image forming units 10*y*, 10*m*, 10*c*, 10*b*. The image forming units 10*y*, 10*m*, 10*c*, 10*b* are disposed in this order and in a line in a rotational driving direction (sub-scanning direction) of an intermediate transfer belt 21 described later, that is, from an upstream of an arrow 29, form electrostatic latent images corresponding to digital signals (hereinafter, referred to as "image information") of colors, and form toner images of the colors. The image forming unit 10*y* forms a toner image corresponding to yellow image information, the image forming unit 10*m* forms a toner image corresponding to magenta image information, the image forming unit 10*c* forms a toner image corresponding to cyan image information, and the image forming unit 10*b* forms a toner image corresponding to black image information. The image forming unit 10*y* includes a photoreceptor drum 11*y*, a charging roller 12*y*, a light scanning unit 13, a developing device 14*y*, and a drum cleaner 15*y*.

The photoreceptor drum 11*y* is rotatably supported by a driving mechanism (not shown) so as to rotate around an axial line and includes a conductive substrate and an organic photosensitive layer (not shown) formed on the surface of the conductive substrate. The conductive substrate, for example, is a cylindrical conductive substrate, a circular conductive substrate, and a sheet-shaped conductive substrate. The cylindrical conductive substrate among the substrates is preferable. A photoreceptor drum generally used in this field may be used as the photoreceptor drum 11*y*, for example, a photoreceptor drum with a diameter of 30 mm which is connected to a ground potential (GND) including an aluminum tube and an organic photosensitive layer formed on the surface of the aluminum tube. The organic photosensitive layer, for example, is formed by laminating a charge generating layer which is a resin layer including a charge generating substance and a charge transporting layer which is a resin layer including a charge transporting substance. The organic photosensitive layer may be a layer containing a charge generating substance and a charge transporting substance in a single resin layer. A thickness of the organic photosensitive layer, for example, is 20 μm. In addition, an undercoat layer may be provided between the organic photosensitive layer and the conductive substrate. On a surface of the organic photosensitive layer is provided a protection layer. Instead of the organic photosensitive layer, an inorganic photosensitive layer formed of zinc oxide, selenium, amorphous silicon or the like may be used. In the embodiment, the photoreceptor drum 11*y* rotates in a circumferential direction at a circumferential speed of 100 mm/s.

The charging roller 12*y* is a roller-shaped which charges the surface of the photoreceptor drum 11*y* into a predetermined polarity and potential. The charging roller 12*y* is connected to a power supply (not shown). Voltage from the power supply is applied to the charging roller 12*y*, which is discharged, whereby the surface of the photoreceptor drum 11*y* is charged. In the embodiment, voltage of −1200 V is applied to the charging roller 12*y* and the surface of the photoreceptor drum 11*y* is charged into −600 V. A brush charger, an electric charger, a corona charger such as a scorotron, and the like may be used instead of the charging roller 12*y*. The light scanning unit 13 illuminates laser light 13*y* corresponding to the yellow image information onto the surface of the photoreceptor drum 11*y* charged by the charging roller 12*y* and forms an electrostatic latent image corresponding to the yellow image information onto the surface of the photoreceptor drum 11*y*. A semiconductor laser and the like are used for the power supply of the laser light 13*y*. In the embodiment, the surface of the photoreceptor drum 11*y* charged with −600 V is exposed and thus an electrostatic latent image is formed with an exposure potential of −70 V.

The developing device 14*y* includes a developing roller 16*y*, a developing blade 17*y*, a toner storing container 18*y*, and agitating rollers 19*y*, 20*y*. Apart of the developing roller 16*y* protrudes outwardly from an opening section 52*y* of the toner storing container 18*y* which is formed so as to face the photoreceptor drum 11*y*. The developing roller 16*y* comes in contact with the surface of the photoreceptor drum 11*y* with pressure, is provided so as to rotate around the axial line, is a roller-shaped member including a fixed magnetic pole (not shown), and supplies the yellow toner 8*y* onto the surface of the photoreceptor drum 11*y*. The developing roller 16*y* rotates in the same direction as the rotational direction of the photoreceptor 11*y* in a developing nip portion coming in contact with the photoreceptor drum 11*y* and thus the rotational direction around the axial line becomes a reverse direction. In the embodiment, the rotational speed of the developing roller 16*y* is 150 mm/s which is 1.5 times as the speed of the photoreceptor drum 11*y*. The developing roller 16*y* is connected to a power supply (not shown) and DC voltage is applied from the power supply to the developing roller 16*y* so as to supply the yellow toner 8*y* to the electrostatic latent image on the surface of the photoreceptor drum 11*y*. In the embodiment, a DC voltage of −240 V as developing potential is applied to the developing roller 16*y*.

The developing blade 17*y* is a plate-shaped member in which one end thereof is supported to the toner storing container 18*y* and the other end comes in contact with the surface of the developing roller 17*y* and makes the yellow toner layer on the developing roller 16*y* even (layer regulation). The toner storing container 18*y*, as described above, has the opening section 52*y* on the surface in contact with the photoreceptor drum 11*y* and is a container-shaped member having an internal space. The developing roller 16*y* and the agitating rollers 19*y*, 20*y* are built in the internal space and stores the yellow toner 8*y*. The yellow toner is supplied from a toner cartridge (not shown) to the toner storing container 18*y* on the basis of a consumption state of the yellow toner 8*y*. In the embodiment, the yellow toner 8*y* is used in form of a two-component developer mixed with a magnetic carrier, but it is not limited thereto and the yellow toner 8*y* may be used in form of a one-component developer including only yellow toner 8*y*.

The agitating roller 19*y*, 20*y* press on and come in contact with each other in the inner space of the toner storing container 18*y* and is a roller-shaped member provided so as to rotate around the axial line. The agitating roller 19*y* is provided so as to press on and come in contact with the developing roller 16*y*. The agitating roller 19*y*, 20*y* mixes the yellow toner 8*y* supplied from the toner cartridge (not shown) into the toner storing container 18*y* and the magnetic carrier filled in the toner storing container 18*y* in advance and supplies into the vicinity of the developing roller 16*y* by the rotational driving thereof. In the embodiment, the photoreceptor drum 11*y* and the developing 16*y*, the developing 16*y* and the developing blade 17*y*, the developing roller 16*y* and the agitating roller 19*y*, and the agitating rollers 19*y*, 20*y* press on and come in contact with each other, respectively, but are not limited thereto. Each may be provided so as to be separated with an air gap.

According to the developing device 14*y*, the yellow toner 8*y* in the toner storing container 18*y* is supplied to the vicinity of the developing roller 16*y* by the agitating rollers 19*y*, 20*y*, is attached onto the developing roller 16*y*, forms the toner layer, the thickness of the toner layer is uniformed by the developing blade 17*y*, and then the toner layer is selectively supplied to the electrostatic latent image of the surface of the photoreceptor drum 11*y* by using differential potential, whereby the toner image corresponding to the yellow image information is formed. The drum cleaner 15*y*, as described below, removes and recollects the yellow toner remaining on the photoreceptor drum 11*y* after the yellow toner image on the surface of the photoreceptor drum 11*y* is transferred to the intermediate transfer belt 21.

According to the image forming unit 10*y*, on the surface of the photoreceptor drum 11*y* charged due to the discharge of the charging roller 12*y*, the electrostatic latent image is formed by illuminating signal light 13*y* corresponding to the yellow image information from the light scanning unit 13, the yellow toner 8*y* is supplied from the developing device 14*y* to the electrostatic latent image by the differential potential, and thus the electrostatic latent image is developed and the yellow toner image is formed. The yellow toner image, as described below, is transferred to the intermediate transfer belt 21 driven in the direction of the arrow 29 in contact with the surface of the photoreceptor drum 11*y*. The yellow toner 8*y* remaining on the surface of the photoreceptor drum 11*y* is removed and recollected by the drum cleaner 15*y*. Since the image forming units 10*m*, 10*c*, 10*b* have a structure similar to the image forming unit 10*y* other than the use of a magenta toner 8*m*, a cyan toner 8*c*, and a black toner 8*b*, the image forming units 10*m*, 10*c*, 10*b* are denoted by the same reference numerals. In addition, "m" denoting magenta, "c" denoting cyan, and "b" denoting black follow the end of the reference numerals and the description thereof is omitted.

The toners 8*y*, 8*m*, 8*c*, 8*b* (hereinafter, referred to as "toner 8" when the distinction is not specifically required) contain a binder resin, a colorant, and a release agent. As the binder resin, a resin softened or swelled by a below-described fixing fluid 9 is not specifically limited, and for example, polystyrene, homopolymer of styrene substituent, styrene copolymer, polyvinyl chloride, polyvinyl acetate, polyethylene, polypropylene, polyester, and polyurethane are used. The binder resin may be used with one or a combination of two or more thereof. A binder resin with a softening temperature of 100 to 150° C. and a glass transition temperature of 50 to 80° C. of these binder resins is preferable for color toner in view of conservation, durability, and softening or swelling control by the fixing fluid 9. Polyester having the softening temperature and glass transition temperature is preferable. The polyester is easily softened and swelled by an available organic solvent and becomes transparent in the softening and swelling state. Accordingly, when a multicolored toner image in which yellow, magenta, cyan, and black toner images are mixed is fixed by the fixing fluid 9, the polyester which is the binder resin becomes transparent. Accordingly, proper color can be obtained by subtractive color mixture. In addition, even when a resin of which the softening temperature and hardness are higher than the binder resin included in the heat fixing toner is used, the toner image can be fixed by the fixing fluid 9. When the resin of which the softening temperature and hardness are high is used, degradation due to load in the course of development is prevented. Consequently, high-quality images can be obtained.

Pigments and dyes for toners used in the past electrophotographic image forming technique can be used as the colorant. Among them, it is preferable that a pigment which is not insoluble in the fixing fluid 9 is used to prevent exudation by applying the fixing fluid 9. It may be used as the pigment, for example, organic pigment such as azo pigment, benzoimidazole pigment, quinacridone pigment, phthalocyanine pigment, isoindolinone pigment, isoindoline pigment, dioxazine pigment, anthraquinone pigment, perylene pigment, perinone pigment, thioindigo pigment, quinophthalones pigment, or metal complex pigment, inorganic pigment such as carbon black, titanium oxide, molybdenum red, chromium yellow, titanium yellow, chromium oxide, or Berlin blue, and metal powder such as aluminum powder. The pigment may be used with one or a combination of two or more thereof. As the release agent, for example, wax can be used. When the wax is softened or swelled by the fixing fluid 9, the wax can be used without specifically limitation. The wax generally used in this field can be used as the wax. Among them, the wax softened or swelled by the fixing fluid 9 is preferable. For specifically example, polyethylene wax, polypropylene wax, paraffin wax, and the like can be used. The toner 8 can contain one or more general toner additive such as a charging control agent, a liquidity improving agent, a fixing accelerant, a conductive agent, and the like, in addition to a binder resin, a colorant, and release agent.

A volume average particle diameter of the toner 8 is not specifically limited but is preferably in the range of 2 to 7 μm. When this small-size toner is used, surface area of the toner per unit area increase and thus the toner is easily fixed. Accordingly, the using amount of the fixing fluid 9 can decrease and the toner image on the recording medium 40 becomes dry at the time of fixing and after fixing for a short time. When the volume average particle diameter of the toner 8 is properly small, a coating rate to the recording medium 40 increases. Accordingly, high quality and decrease in consumption of the toner in the low-fixing amount can be accomplished, and further, decrease in consumption of the fixing fluid 9 can be accomplished. When the volume average particle diameter of the toner 8 is smaller than 2 μm, the liquidity of the toner 8 decreases, supply, agitation, charging of the toner 8 is insufficient during the developing process, the amount of the toner 8 is short and a reverse polarity toner increases, and thus high-quality image may not be obtained. Meanwhile, when the volume average particle diameter is larger than 7 μm, the toner with large particle diameter hardly softened and/or swelled to the center of the toner particle increases. Accordingly, fixedness of the image to the recording medium decreases, the color of the image is degraded, and particularly, the image fixed to the OHP (over head projector) paper becomes dark. The softening temperature and the glass transition temperature of the toner 8 are not specifically limited. However, preferably, the softening temperature is in the range of 100 to 130° C. and the glass transition temperature is in the range of 50 to 80° C. This toner 8 with high softening temperature is preferable for improving the durability against the load in the course of the development but is not sufficiently fixed and colored in the heat fixing method. In the embodiment, since the toner 8 is chemically softened and/or swelled by using the fixing fluid 9, the fixture and color are sufficient and thus high-quality image is obtained. In addition, when the toner 8 includes a plurality of binder resins, the toner 8 may present a plurality of softening temperatures or a plurality of glass transition temperatures. In this case, the softening temperature or the glass transition temperature of the toner 8 indicate the lowest temperature of the softening temperature or the glass transition temperature of the plurality softening temperatures or glass transition temperatures.

The toner 8 can be manufactured by the known method, for example, a pulverizing method pulverizing and classifying a cooling solidified substance of the molten kneaded substance obtained by melting and kneading the binder resin, the colorant, the release agent, and the like and a method in which the release agent, the colorant, and the like are dispersed to the monomer solution of the binder resin and then the monomer of the binder resin is polymerized. In any method, it is more preferable to adjust the shape of the toner 8 has an infinite shape than a globular shape so as to increase the surface area of the toner 8. Accordingly, since the toner 8 easily comes in contact with the fixing fluid 9, the consumption of the fixing fluid 9 decreases and thus the fixture and the dryness of the toner image are performed for a short time. The toner 8 may be used as a one-component developer or as a two-component developer mixed with a carrier.

The toners 8*y*, 8*m*, 8*c*, 8*b* used in the embodiment have the same configurations shown below other than pigments. The toner 8 has a glass transition temperature of 60° C., a softening temperature of 120° C., and a volume average particle diameter of 6 μm and is an insulating non-magnetic toner with a sub-charging property. In order to obtain image density of which reflective density value is 1.4 measured by 310 made in X-Rite, the toner amount of 5 g/m$^2$ is needed.

The toner 8 includes the polyester (binder resin) with a glass transition temperature of 60° C. or softening temperature of 120° C., a low-molecular polyethylene wax (release agent) with a glass transition temperature of 50° C. or a softening temperature of 70° C., and pigments with each color. The toner 8 is polyester in which the wax is contained by 7% by weight of the total toner, the pigment is contained by 12% by weight of the total of the toner 8, and remainder is the binder resin. The glass transition temperature and the softening temperature of the low-molecular polyethylene wax included in the toner 8 are lower than that of polyester. When this wax is used, adhesive power between toners and adhesive power between a toner and the intermediate transfer belt 21 or the recording medium 40 increase even in the lower temperature than the glass transition temperature. Accordingly, when the fixing fluid 9 which is liquid substance is applied, it can be suppressed that the bleeding, aggregation, and the like of the toner occur. In addition, when the wax of the toner is softened, the fixing fluid 9 is easily penetrated from a part where the wax exists into the toner. Accordingly, in the course of applying the fixing fluid 9, the whole toner is softened and/or swelled, the sufficient fixing strength is obtained in the course of the transfer to the recording medium 40, and thus the coloring by the superposition of the toner image is sufficiently accomplished.

The intermediate transfer section 3 includes an intermediate transfer belt 21, intermediate transfer rollers 22*y*, 22*m*, 22*c*, 22*b*, support rollers 25, 26, 27, and a belt cleaner 28. The intermediate transfer belt 21 is a toner image carrying section with an endless belt shape which forms a loop passage and which is tightly suspended between the support rollers 25, 26, 27 and rotates in a direction of an arrow 29 at the substantially same speed as the photoreceptor drums 11*y*, 11*m*, 11*c*, 11*b*. The intermediate transfer belt 21 has a configuration that the fixing fluid 9 is not penetrated to the inside thereof, for example, a laminating agent including a coating layer with fluoroplastic formed on the surface of the film base material.

The film base material, for example, may be a base material in which resin materials such as polyimide, polycarbonate, and the like rubber materials such as fluororubber are formed into the film form. The fluoroplastic coating layer includes fluoroplastic such as polytetrafluoroethylrene (PTFE), tetra fluoroethylrene, perfluoroalkyl vinyl ether copolymer (PFA), and mixture thereof. In order to adjust electric resistance value as the intermediate transfer belt 21, conductive materials may be mixed for the film base material and/or the fluoroplastic coating layer. As the conductive materials, for example, furnace black, thermal black, channel black or graphite carbon, and the like may be used. The intermediate transfer belt 21 is not limited to a belt form but, for example, may be formed in a drum form.

In the embodiment, the coating layer with a thickness of 20 μm consisting of a fluoroplastic composition including PTFE and PFA with 8 to 2 (weight ratio) on the surface of the polyimide film with a thickness of 100 μm may be provided. The surface of the fluoroplastic coating layer is a toner image carrying surface 21*a*. The toner image carrying surface 21*a* of the intermediate transfer belt 21 comes in contact with the photoreceptor drums 11*y*, 11*m*, 11*c*, 11*b* in this order. A position of the intermediate transfer belt 21 come in contract with the photoreceptor drums 11*y*, 11*m*, 11*c*, 11*b* is an intermediate transfer position of the toner image of each color. The intermediate transfer rollers 22*y*, 22*m*, 22*c*, 22*b* are disposed at a position opposed to the photoreceptor drums 11*y*, 11*m*, 11*c*, 11*b* through the intermediate transfer belt 21.

The intermediate transfer rollers 22*y*, 22*m*, 22*c*, 22*b* come in contact with the carrying surface 21*a* of the toner image opposed to the photoreceptor drums 11*y*, 11*m*, 11*c*, 11*b* through the intermediate transfer belt 21, respectively and are a roller-shaped member provided so as to rotate around the axial line by a driving mechanism (not shown). In the intermediate transfer rollers 22*y*, 22*m*, 22*c*, 22*b*, for example, a roller-shaped member including a metal shaft and a conductive layer coating the surface of the metal shaft is used. The shaft, for example, is formed of metal such as stainless steel. A diameter of the shaft is not specifically limited but is preferably 8 to 10 mm.

The conductive layer is formed for the purpose of uniformly applying high voltage to the intermediate transfer belt 21, for example, is formed of a conductive elastic body. The conductive elastic body generally used in this field may be used, for example, may be a conductive elastic body in which conductive materials, such as carbon black, are dispersed in matrixes such as ethylene propylene diene rubber (EPDM), poly EPDM, and polyurethane.

In order to transfer the toner image, formed on the surface of the photoreceptor drums 11*y*, 11*m*, 11*c*, 11*b*, onto the intermediate transfer belt 21, an intermediate transfer bias with a reverse polarity against the charging polarity of the toner is applied to the intermediate rollers 22*y*, 22*m*, 22*c*, 22*b*. Accordingly, the toner images of yellow, magenta, cyan, and black formed in the photoreceptor drums 11*y*, 11*m*, 11*c*, 11*b* is sequentially transferred to and overlaid on the toner image carrying surface 21*a* of the intermediate transfer belt 21 and thus multicolored toner image is formed. However, when a part of the yellow, magenta, cyan, and black image information is inputted, the toner image is formed only in the image forming unit corresponding to colors of the inputted image information of the image forming units 10*y*, 10*m*, 10*c*, 10*b*.

The support rollers 25, 26, 27 are provided so as to be rotated around the axial line by a driving mechanism (not shown) and tightly suspended and rotates the intermediate transfer belt 21 in the direction of the arrow 29. For example, an aluminum pipe roller with a diameter of 30 mm and a thickness of 1 mm is used in the support roller 25, 26, 27. The support roller 26 come in contact with a below-described secondary transfer roller 30 is electrically connected to the ground through the intermediate transfer belt 21.

The belt cleaner 28 is a member which after transfer of the toner image on the toner image carrying surface 21*a* of the intermediate transfer belt 21 to the recording medium 40 in a below-described secondary transfer section 4, removes the toner remaining on the toner image carrying surface 21*a*. The belt cleaner 28 includes a cleaning blade 28*a* and a toner container 28*b*. The cleaning blade 28*a* is a plate-shaped member which is provided to be opposed to the support roller 27 through the intermediate transfer belt 21 and to come in contact with the toner image carrying surface 21*a* by a pressing section (not shown) and which rakes out the remaining toner, paper power, and the like on the toner image carrying surface 21*a*. For example, a blade made of a rubber material having elasticity such as urethane rubber may be used as the cleaning blade 28*a*. The toner container 28*b* stores the remaining toner, the offset toner, the paper powder, and the like raked by the cleaning blade 28*a*.

By the intermediate transfer section 3, the multicolored toner image is formed by transferring the toner images with the respective colors formed on the photoreceptor drums 11*y*, 11*m*, 11*c*, 11*b* are overlaid and transferred on the toner image carrying surface 21*a* of the intermediate transfer belt 21. In the secondary transfer section 4, the multicolored toner image is transferred to the recording medium 40, the remaining toner, the offset toner, the paper powder, and the like are removed by the belt cleaner 28, and then the toner image is retransferred on the toner image carrying surface 21*a*.

The secondary transfer section 4 includes a support roller 26 and a secondary transfer roller 30. The secondary transfer roller 30 comes in contact with the support roller 26 through the intermediate transfer belt 21, is provided so as to be rotated around the axial line, and mainly functions as a pressing roller. The secondary transfer roller 30, for example, includes a metal core having a diameter of 10 mm and an urethane rubber layer having a thickness of 4 mm formed on an outer periphery of the metal core. In order to give conductivity to the urethane rubber layer, conductive materials such as carbon are mixed thereto. The secondary transfer roller 30, for example, is pressed to the support roller 26 with a line pressure of 1N/cm. When the toner image on the intermediate transfer belt 21 is transferred to the recording medium 40 by the secondary transfer roller 30, for example, a voltage of +1 kV is applied to the metal core of the secondary transfer roller 30. By the secondary transfer section 4, the intermediate transfer belt 21 carrying the multicolored toner image is transferred to a contact portion (secondary transfer nip portion) between the secondary transfer roller 30 and the support roller 26. The recording medium 40 is supplied from the below-described recoding medium supplying section 7 and the multicolored toner image on the intermediate transfer belt 21 is transferred onto the surface of the recording medium 40 by pressure. The recording medium 40 to which the multicolored toner image is transferred is conveyed to the fixing section 6 through the conveyer section 31. Before the multicolored toner image on the recording medium 40 is fixed to the recording medium 40 in the fixing section 6, the fixing fluid 9 is applied by the fixing fluid applying section 5.

The conveying section 31 includes a conveyer belt 32, a driving roller 33, and a tension roller 34. The convey belt 32 is tightly suspended between the driving roller 33 and the tension roller 34. The convey belt 32 is an endless belt which forms a loop passage and rotates as the driving roller 33 rotates. The driving roller 33 is a roller-shaped member provided so as to be rotated by a driving mechanism (not shown). The tension roller 34 is provided so as to rotate in accompanying with the rotation of the driving roller 33 and applies a tension to the conveyer belt 32. By the conveying section 31, the recording medium 40 to which the toner image is transferred in the transfer nip portion of the secondary transfer section 4 is conveyed toward the fixing section 6.

The fixing fluid applying section 5 includes a fixing fluid reservoir 37, a droplet supplying section 80, and a supply tube 38 and applies the fixing fluid 9 to the toner image on the recording medium 40 while conveyed from the transfer section toward the fixing section. The fixing fluid reservoir 37 is a container-shaped member provided in the internal space of the image forming apparatus 1 and stores the fixing fluid 9 in the internal space. The fixing fluid reservoir 37, for example, may be configured in the cartridge manner. When the fixing fluid 9 in the fixing fluid reservoir 37 is consumed and is replaced with a new cartridge of the fixing fluid reservoir 37, the fixing fluid 9 can be easily replenished. Further, the fixing fluid reservoir 37 is configured as a stationary type and thus the fixing fluid 9 may be replenished.

The droplet supplying section 80 is provided so as to reciprocate in a direction perpendicular to the conveying direction of the recording medium 40 by a driving mechanism (not shown) (for example, a below-described carriage 109). A fixing fluid spray nozzles are formed on the lower surface of the droplet supplying section 80 and the droplets of the fixing fluid 9 are supplied to the toner image on the recording medium 40. For the droplet supplying section 80, for example, a liquid supplying device having a nozzle head is used. In the embodiment, in consideration that it is difficult that a variation in composition of the fixing fluid 9 and clogging in the nozzle occur, a piezoelectric line ink jet head is used. The line ink jet head has one or more rows of the spray nozzles in which a plurality of spray nozzles are arranged to be parallel to the conveying direction of the recording medium the lower surface thereof. Accordingly, the line ink jet head has a proper width in the conveying direction of the recording medium 40. The line ink jet head can supply the fixing fluid 9 at a time and supply the fixing fluid 9 from only any of all spray nozzles. Accordingly, it is possible to make such a control that the fixing fluid 9 is supplied from a fixing fluid spray nozzle which is close to the fixing nip portion and is not supplied from a fixing fluid spray nozzle which is not close to the fixing nip portion. By this configuration, the supplying amount of the fixing fluid 9 can increase in the fixing nip portion.

The spray nozzle pitch is set to be lower than an image resolution in the toner image forming section 2. The reason is that the fixing fluid 9 is dispersed on the recording medium 40 and thinly spreads. Herein, the image resolution in the toner image forming section 2 means how extent the image is presented with the precise dot. Preferably, the spray nozzle pitch is 150 dpi (dot per inch) or less, more preferably, in the range of 75 to 150 dpi. In the embodiment, the image resolution in the toner image forming section 2 is set to 600 dpi and the spray nozzle pitch of the ink jet head is set to 75 dpi. In the piezoelectric ink jet head, price thereof extremely varies on the basis of the number of fixing fluid spray nozzles. However, according to the invention, since it is not required to use the ink jet head with high resolution, the cost does not increase by applying the ink jet head. In addition, the applying amount of the fixing fluid 9 to the toner image on the recording medium 40 by the fixing fluid applying section 5 is controlled by a fixing fluid amount controlling section (not shown) to gradually increase as it approaches the pressure-contact portion (fixing nip portion) between the below-described a first pressing roller 62 and a second pressing roller 63.

The fixing fluid amount controlling section is described below in detail. For example, the fixing fluid amount controlling section may be configured so as to perform one-drop ejection in a part which is not close to the fixing nip portion and to perform nine-drop ejection in a part close to the fixing nip portion by using an ink jet head capable of performing multi-drop control as an ink jet head. The ink jet head capable of performing the multi-drop control is known and disclosed for example, in Japanese Unexamined Patent Publication JP-A 8-207319 or the like. In addition, the ink jet head capable of performing the multi-drop control has been on the market by Toshiba Tec Corporation. In addition, by using the ink jet head performing the one-drop ejection from the each fixing fluid spray nozzle, it may be controlled to further increase the number of reciprocation scanning in the part close to the fixing nip portion than the part which is not close to the fixing nip portion. One end of the supply tube 38 is connected to the fixing fluid reservoir 37 and the other end thereof is connected to the droplet supplying section 80. The supply tube 38 supplies the fixing fluid 9 in the fixing fluid reservoir 37 to the droplet supplying section 80 according to consumption state of the droplet supplying section 80.

The fixing fluid 9 is liquid substance which softens and/or swells the toner 8. The preferable fixing fluid 9 includes an organic compound (hereinafter, referred to as "toner fixing organic compound") softening and/or swelling the toner and a solvent component capable of dissolving or dispersing the toner fixing organic compound. As the toner fixing organic compound, for example, may be alcohol such as methyl alcohol, ethyl alcohol, propyl alcohol, isopropyl alcohol, and butyl alcohol; keton such as acetone, methyl ethyl keton, methyl butyl keton, methyl isobutyl keton, and diethyl keton; ether such as methyl ethyl ether, diethyl ether, methyl butyl ether, methyl isobutyl ether, and dimethyl ether; and ester formed of carbonic acid such as formic acid or acetic acid, propionic acid, and butyric acid and alcohol such as methanol, ethanol, and propanol. Among these, ether and ester is preferable, and more particularly, ester is preferable. Particularly, diethyl ether is preferable among ether. Acetic acid ethyl, acetic acid methyl, formic acid methyl, formic acid ethyl, and the like are more preferable among ester, and more particular, acetic acid ethyl is preferable. The toner fixing organic compound may be used as one or a combination of two or more thereof. The toner fixing organic compound has volatility at normal temperature and excellently softens and/or swells the toner binder resin such as polyester. The containing amount of the toner fixing organic compound in the fixing fluid 9 is not specifically limited and may be properly selected in the wide extent. Preferably, the amount is in the range of 1 to 50% by weight of total amount of the fixing fluid 9, more preferably, in the range of 5 to 50% by weight of total amount of the fixing fluid 9, and more particularly, in the range of 10 to 40% by weight of total amount of the fixing fluid 9. In the amount smaller than 1% by weight, since effect of softening and/or swelling of the toner is insufficient, the fixing strength of the toner image to the recording medium 40 may decrease. In the amount lager than 50% by weight, since the containing amount of the solvent component relatively decreases and the osmosis of the fixing fluid 9 into the toner image decreases and thus only surface layer of the toner image is softened and/or swelled, the fixing strength of the toner image to the recording medium 40 may decrease.

As the solvent component, a liquid component capable of dissolving or dispersing the toner fixing organic compound is not specifically limited but hydrofluoroether is preferable in consideration of osmosis into the toner image of the fixing fluid 9. Since the hydrofluoroether has small surface tension and viscosity, the hydrofluoroether easily percolates the toner particles and the contact surface between the toner and the recording medium 40. Accordingly, the toner fixing organic compound is transferred together with the hydrofluoroether to the toner particles and the contact surface between the toner and the recording medium 40 and thus can soften and/or swells the toner in a moment. In addition, since the hydrofluoroether has small evaporative latent heat, the hydrofluoroether is volatilized for a short time even in a room temperature and thus becomes quickly dry on the recording medium 40. As the hydrofluoroether, the known things may be used, for example, methyl nonafluorobutyl ether, methyl nonafluoroisobutyl ether ($C_3F_9OCH_3$), ethyl nonafluorobutyl ether, ethyl nonafluoroisobutylether ($C_3F_9OC_2H_5$), 1,1,2,2-tetrafluoroethyl, 2,2,2-trifluoroethyl ether ($CHF_2CF_2OCH_2CF_3$), and the like. The hydrofluoroether may be used as one or a combination of two or more thereof. The containing amount of the hydrofluoroether in the fixing fluid 9 is not specifically limited and may be properly selected in wide extent. Preferably, the amount is in the range of 50 to 99% by weight of total amount of the fixing fluid 9, more preferably, in the range of 50 to 95 weight of total amount of the fixing fluid 9, and particularly preferably, in the range of 60 to 90% by weight of total amount of the fixing fluid 9. In the amount smaller than 50% by weight, since the osmosis of the fixing fluid 9 into the toner image decreases, only surface layer of the toner image is softened and/or swelled and the fixing strength of the toner image to the recording medium 40 may decrease. Meanwhile, in the amount lager than 99% by weight, since the containing amount of the toner fixing organic compound relatively decreases and thus the softening and swelling effect of the fixing fluid 9 to the toner decreases, the fixing strength of the toner image to the recording medium 40 may be decrease. Into the fixing fluid 9, there may be added a surfactant which keeps a dispersion state underwater of the toner fixing organic compound other than the toner fixing organic compound and the solvent component and which improves a wet property of the fixing fluid 9 to the toner. As the surfactant, the known thing may be used, for example, an anionic surfactant such as fatty acid derivatives sulfuric acid ester salt and phosphoric ester salt; a cationic surfactant such as quaternary ammonium salt and heterocyclic ring amine; a zwitterionic surfactant such as amino acid ester and amino acid; and an onionic surfactant such as polyoxyalkylene alkyl ether and polyoxyethylene alkyl amine.

The fixing section 6 includes a driving roller 61, a first pressing roller 62, a second pressing roller 63, and a recording medium conveyer belt 64. The driving roller 61 is provided so as to rotate around the axial line by a driving mechanism (not shown) and is a hollow roller-shaped member having a heating section 65 therein. The driving roller 61 rotates and drives the recording medium conveyer belt 64 and heats the recording medium conveyer belt 64. As the driving roller 61, for example, a hollow roller made of metal such as aluminum may be used. As the heating section 65, for example, a heater such as a halogen lamp and an infrared heater may be used. By the driving roller 61, the toner image on the recording medium 40 placed on the surface of the recording medium conveyer belt 64 is heated preferably at a temperature slightly lower than the glass transition temperature of the toner 8 constituting the toner image. For example, when the glass transition temperature of the toner 8 is 60° C., the temperature is preferably in the ranger of 55 to 58° C., more preferably, 56° C. In order to heat the toner image at a temperature in the range of 55 to 58° C., a surface temperature of the recording medium conveyer belt 64 should be kept at 70° C. The temperature control of the recording medium conveyer belt 64 is described below in detail. In the embodiment, the driving roller 61 having a heating heater 65 built therein is used as the heating section. However it is not limited thereto and a contact heating section such as a roller and a fixed plate and a non-contact heating section such as an infrared heater may be used.

The first pressing roller 62 is provided so as to be rotate by a driving mechanism (not shown) and to come in contact with the second pressing roller 63 with pressure through the recording medium conveyer belt 64. The recording medium carrying the toner image to which the fixing fluid 9 is applied passes through the pressure-contact portion (fixing nip portion) between the first pressing roller 62 and the second pressing roller 63, whereby the swelled and softened toner image is pressed and fixed to the recording medium 40. In order to stably rotate the recording medium conveyer belt 64, the first pressing roller 62 applies predetermined tension so that the recording medium conveyer belt 64 does not become loose. As the first pressing roller 62, for example, a roller-shaped member having a metal core, an elastic layer formed on the surface of the metal core, and a surface layer formed on the surface of the elastic layer may be used.

As the elastic layer, the known elastic materials may be used, for example, rubber materials such as EPDM rubber, butyl rubber, nitrile rubber, chloroprene rubber, and styrene-butadiene rubber. The rubber materials may be used as one or a combination of tow or more thereof. Since these rubber materials are not swelled by the fixing fluid 9 and have good property to the roller shape, the materials can be preferably used. Since the elastic layer is configured as materials which is not swelled by the fixing fluid 9, it is prevented that variation in outer diameter of the first pressing roller 62 where the fixing fluid 9 is infiltrated into the recording medium 40 and is attached to the first pressing roller 62 and further variation in reaction velocity of the recording medium 40.

Fluoroplastic such as polytetrafluoroethylene (PTFE), tetrafluoroethylene-perfluoroalkyl vinyl ether copolymer (PFA), tetrafluoroethylene-hexafluoropropylene copolymer (FEP), tetrafluoroethylene-ethylene copolymer (ETFE), polyvinylidene fluoride (PVDF), and polychlorotrifluoroethylene (PCTFE) may be preferably used as the surface layer. The fluoroplastic may be used as one or a combination of two or more thereof.

In the embodiment, a roller with an outer diameter of 30 mm including a metal core, an elastic layer formed of EPDM with hardness of 50 degree (JIS-A) with thickness of 3 mm, and a surface layer formed of PFA with thickness of 80 μm is used. In the embodiment, pressing force of the first pressing roller 62 against the second pressing roller 63 is 10 N/cm. Further, a roller-shaped member including a metal axis and a coating layer formed on the surface of the metal axis may be used as the first pressing roller 62. Further, a roller-shaped member including only the metal axis may be used. As the metal axis, for example, stainless steel is used and as the materials of the coating layer, for example, fluororubber is used. Further, the materials may be a metal hollow roller.

The second pressing roller 63 is provided so as to be rotated by a driving mechanism (not shown), is pressed by the first pressing roller 62, and thus forms the fixing nip portion together with the first pressing roller. As the second pressing roller 63, a roller-shaped member having the same configuration as the first pressing roller 62 may be used. That is, the second pressing roller is a roller-shaped member including a metal metal core, an elastic layer formed on the surface of the metal core, and a surface layer formed on the surface of the elastic layer. Since one or more of the same rubber materials as the rubber may be used as the elastic layer, the same effect as the first pressing roller 62 arises. As the surface layer, one or more of fluoroplastic mentioned above may be used. Since the fluoroplastic has a high affinity for the solvent component of the fixing fluid 9, the fluoroplastic allows the fixing fluid 9 not to bleeding or cohere at the time of contact with the surface of the second pressing roller 63. Consequently, even when the surface of the second pressing roller 63 and the fixing fluid 9 on the recording medium 40 comes in contact with each other in just front of the fixing nip portion, the recording medium 40 can be conveyed to the fixing nip portion without movement of the position of the fixing fluid 9 on the recording medium 40. Accordingly, the toner image can be fixed to the recording medium with a predetermined fixing strength. Among the fluoroplastic, the PFA is preferable. Particularly, the PFA is hardly attached to the toner 8, has a high affinity with the solvent component of the fixing fluid 9, and is most effective for decrease in consumption of the fixing fluid 9 and for preventing that the toner is attached to the second pressing roller 63. In the embodiment, a roller with an outer diameter of 30 mm including an elastic layer formed of EPDM rubber with hardness of 20 degree (JIS-A) with thickness of 3 mm on the surface of the metal core and a surface layer formed of PFA with thickness of 80 μm is used as the second pressing roller 63.

The recording medium conveyer belt 64 is an endless belt which is stretched between the driving roller 61 and the first pressing roller 62 and is formed in a loop shape and which rotates in a direction of an arrow 46. As the recording medium conveyer belt 64, a belt-shaped member generally used in this field may be used. In the embodiment, it is used a belt in which a surface layer with thickness of 10 μm formed of PTFE provided on at least one surface of polyimide film with thickness of 100 μm to which conductivity is given by mixing conductive materials.

The temperature control of the recording medium conveyer belt 64, for example, is performed according to the sensed result of the surface temperature of the recording medium conveyer belt 64 by a temperature sensor (not shown) which comes in contact with or which is close to the recording medium conveyer belt 64. The result sensed by the temperature sensor is sent to a CPU (not shown) which controls the whole operation of the image forming apparatus 1. The CPU includes a storage section, an operating section, and a control section. The result sensed by the temperature sensor, a heat setting temperature of the recording medium conveyer belt 64, and the like are inputted to the storage section. The calculation section fetches the heat setting temperature from the recording medium conveyer belt 64, compares the surface temperature at the time of judgment of the recording medium conveyer belt 64 with the heat setting temperature, and judges whether the surface temperature at the time of judgment is higher than the heat setting temperature or is lower than that. The control section sends a control signals to the power supply (not shown) which supplies power to the heating section 65 according to the judged result that the surface temperature is lower than the heat setting temperature and controls the heating amount of the heating section 65.

In the embodiment, the surface temperature of the recording medium conveyer belt 64 is kept at 70° C. and thus a temperature of the toner image on the recording medium 40 placed on the recording medium conveyer belt 64 is set to be slightly lower than the glass transition temperature (60° C.) of the toner. However, it is not limited thereto, for example, the surface temperature of the recording medium conveyer belt 64 may be kept at 80° C. and the temperature of the toner image on the recording medium 40 may be higher than the glass transition temperature (60° C.). Accordingly, the toner is softened in some extent before or at the same time of applying the fixing fluid 9 and thus the adhesion of toner each other and between the toner and recording medium 40 is enhanced. Consequently, movement and aggregation of the toner by the fixing fluid 9 can be prevented in the course of applying the fixing fluid 9. In addition, the surface temperature of the recording medium conveyer belt 64 may be kept at 130° C. and the temperature of the toner image on the recording medium 40 may be higher than the glass transition temperature (120° C.) of the toner. Accordingly, the toner is sufficiently softened, the adhesion of toner each other and between the toner and recording medium 40 is further enhanced, whereby movement and aggregation of the toner by the fixing fluid 9 can be further prevented in the course of applying the fixing fluid 9. This example are a case that a toner having the glass transition temperature of 60° C. or 120° C. is used and the surface temperature of the recording medium conveyer belt 64 may be modified according to the glass transition temperature or softening temperature of the toner. A temperature detecting section (not shown) together with the heating section 65 may be provided inside the driving roller 61 to perform the temperature control of the recording medium conveyer belt 64 in the same manner mentioned above. In this case, when a relation between the internal temperature of the driving roller 61 and the surface temperature of the recording medium conveyer belt 64 is measured in advance, the temperature control is easily performed. Herein, as the temperature detecting section, for example, a thermistor and the like may be used.

According to the fixing section 6, the fixing fluid 9 is applied to the toner image on the recording medium 40 which is placed on the recording medium conveyer belt 64 and which is conveyed in the heating state, the toner constituting the toner image is sufficiently swelled and softened, the toner image together with the recording medium 40 passes through the fixing nip portion and is pressed, the toner image is fixed to the recording medium 40, and thus the final image is formed. The recording medium 40 having the final image formed thereto is discharged into a catch tray 41 provided outside the image forming apparatus 1 by a paper discharge roller (not shown).

The recording medium supplying section 7 includes a recording medium cassette 42, a pickup roller 43, and a pair of registration rollers 44*a*, 44*b*. The recording medium cassette 42 stores the recording medium 40. The recording medium 40, for example, is normal paper, coat paper, color-copy paper, an OHP (overhead projector) film, a postcard, and the like. Preferably, size of the recording medium 40 is A3, A4, B4, B5, postcard size, and the like. The pickup roller 43 supplies the recording medium 40 stored in the recording medium cassette 42 to a conveying passage Pone by one. The registration rollers 44*a*, 44*b* supply the recording medium 40 to the transfer nip portion in synchronization with transferring the multicolored toner image on the intermediate transfer belt 21 to the transfer nip portion. According to the recording medium supplying section 7, the recording medium 40 stored in the recording medium cassette 42 is supplied to the conveying passage P by the pickup roller 43 one by one and is supplied to the transfer nip portion by the registration rollers 44*a*, 44*b*.

Figure 4:
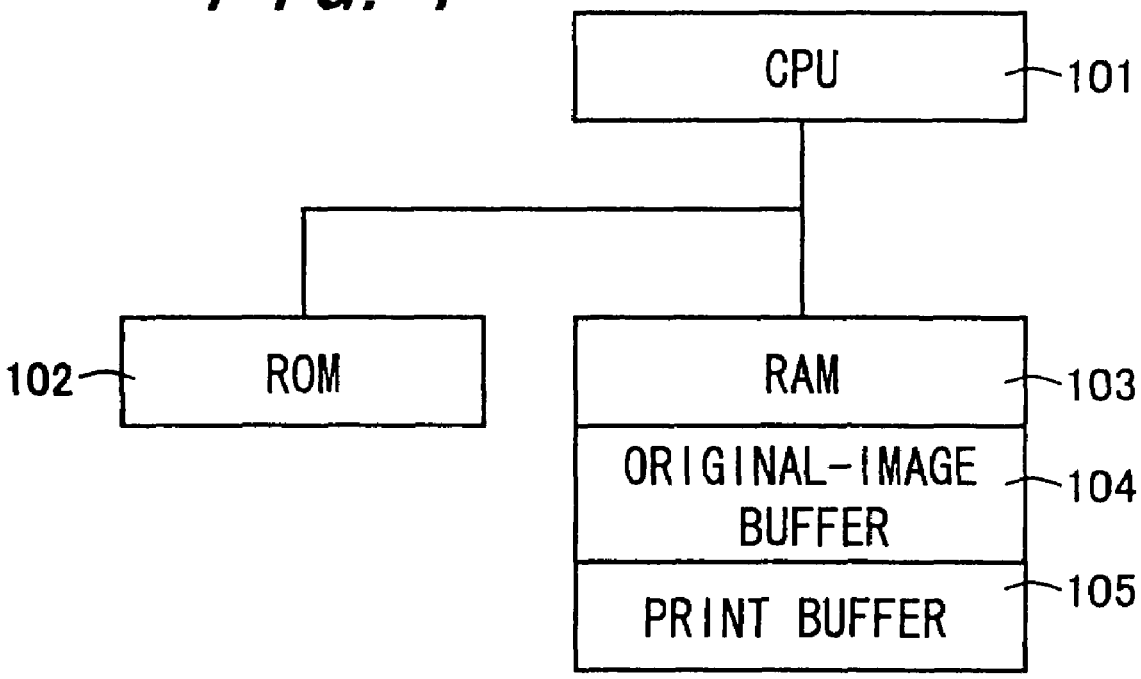
FIG. 4 is a schematic block diagram schematically illustrating a configuration of the fixing fluid amount controlling section in the embodiment of the invention.

FIG. 4 is a schematic block diagram schematically illustrating a configuration of the fixing fluid amount controlling section in the embodiment of the invention. A control unit 120 included in the image forming apparatus 1 functions as the fixing fluid amount controlling section. The control unit 120 includes a CPU (central processing unit) 101, a read only memory (ROM) 102 and a random access memory (RAM) 103 as a storage section. The control unit 120 controls the fixing fluid amount when an ink jet head 80*a* in which all fixing fluid spray nozzles perform one-drop ejection is used as the droplet supplying section 80 in the fixing fluid applying section 5. Programs are stored in the ROM 102. The programs, specifically, is a program which increases the amount of the fixing fluid accumulated to the toner image on the recording medium 40 by increasing the number of reciprocation movement of the ink jet head in a direction perpendicular to the conveying direction of the ink jet head as the recording medium 40 approaches the fixing nip portion in the course of transferring the recording medium 40 to the fixing nip portion, an image data processing program, and the like. The CPU 101 performs a control for operation of the ink jet head, data process, and the like according to the program stored in the ROM 102.

The RAM 103 includes an original-image buffer 104 temporarily storing image information and a print buffer 105 temporarily storing print data and becomes a work area when the CPU 101 performs the data process and the like. The original-image buffer 104 is an original-image buffer memory which temporarily stores image information sent from a manuscript reading section (not shown) provided in an external device such as a computer or the image forming apparatus 1 as 8 bit 256 tone signals to the R (red), G (green), and B (blue). The R, G, and B image data stored in the original-image buffer 104 is processed by the CPU 101 and converted to data of Y (yellow), M (magenta), and C (cyan) according to predetermined variation. Then, a predetermined image process is performed, and finally, multi-value process is performed to the image data of Y, M, and C. Accordingly, in each pixel, for example, when three-value process is performed, any one print data of (Y0, M0, C0), (Y1, M1, C1), and (Y2, M2, C2) is obtained. This print data is temporarily stored in the print buffer 105. Consequently, dot nonexistence (Y0, M0, C0), dot existence (Y1, M1, C1), and two-value processed data which are data indicating existence or nonexistence of dot for Y, M, and C are stored in the print buffer 105.

The CPU 101 controls the ejection of the droplets from the ink jet head according to the print data stored in the print buffer 105. That is, The CPU 101, as the recording medium 40 approaches the fixing nip portion, increases the number of reciprocating scanning (reciprocating movement) of the ink jet head 80*a* of the droplet supplying section 80 in a direction perpendicular to the conveying direction of the recording medium, increases the amount of the fixing fluid supplied to the toner image, and controls that the fixing fluid 9 is not supplied to the dot nonexistence part according to the print data for existence or nonexistence of dot. More specifically, according to the print data about the existence or nonexistence of the dot, a program may be drew up so as to continuously supply the fixing fluid from a fixing fluid spray nozzle which is close to the fixing nip portion of the ink jet head, to intermittently supply the fixing fluid from a fixing fluid spray nozzle which is not close to the fixing nip portion, and thus, to increase a time interval of the fixing fluid ejection as it becomes apart from the fixing nip portion. At the time, the program may be made by determining where intermittent ejection of the fixing fluid starts in the conveying direction of the recording medium 40 while considering conditions such as the reaction velocity of the recording medium 40 and the dot distribution in the recording medium 40.

Figure 5:
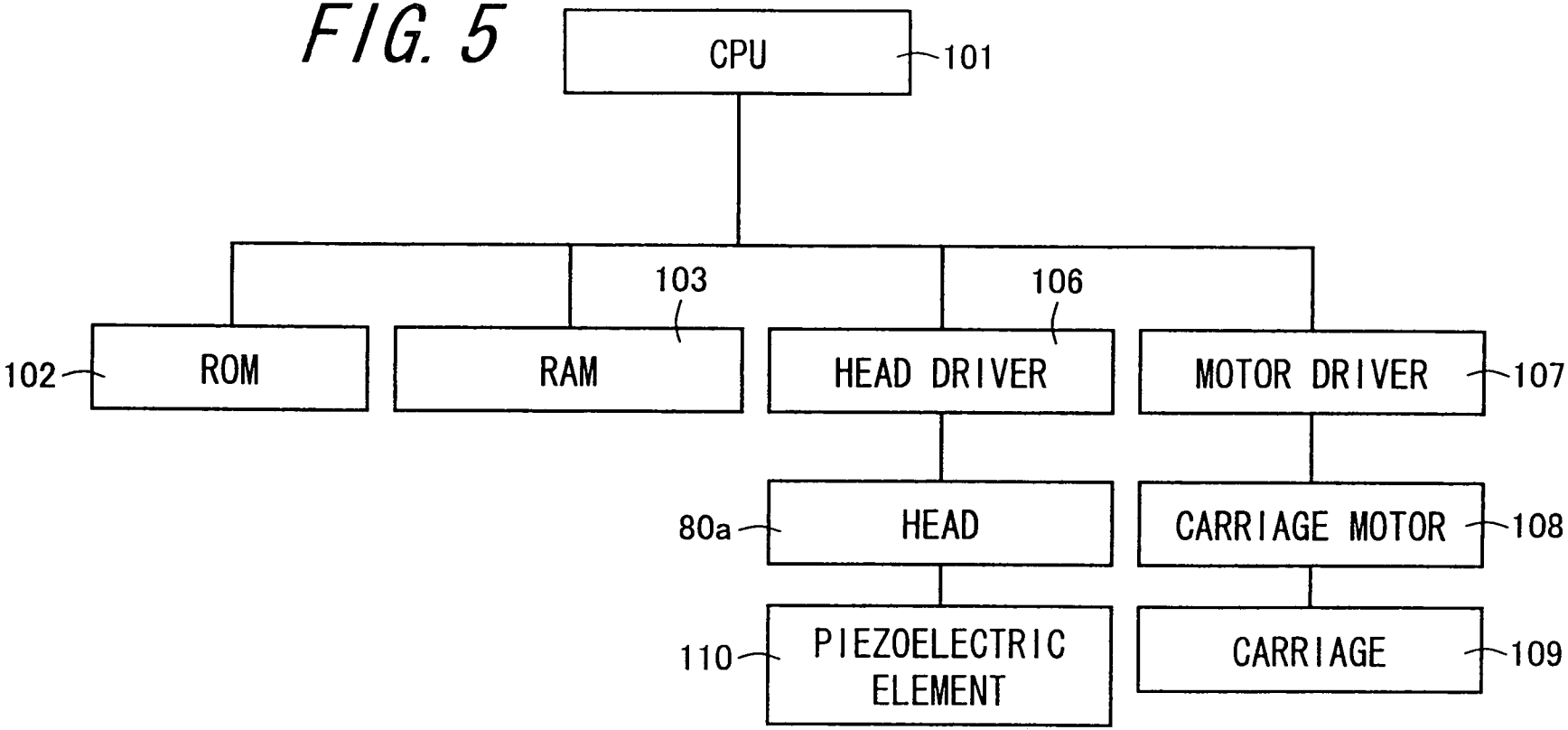
FIG. 5 is a block diagram schematically illustrating a configuration of a droplet ejection control of the fixing fluid by the fixing fluid amount controlling section shown in FIG. 4.
Figure 6:
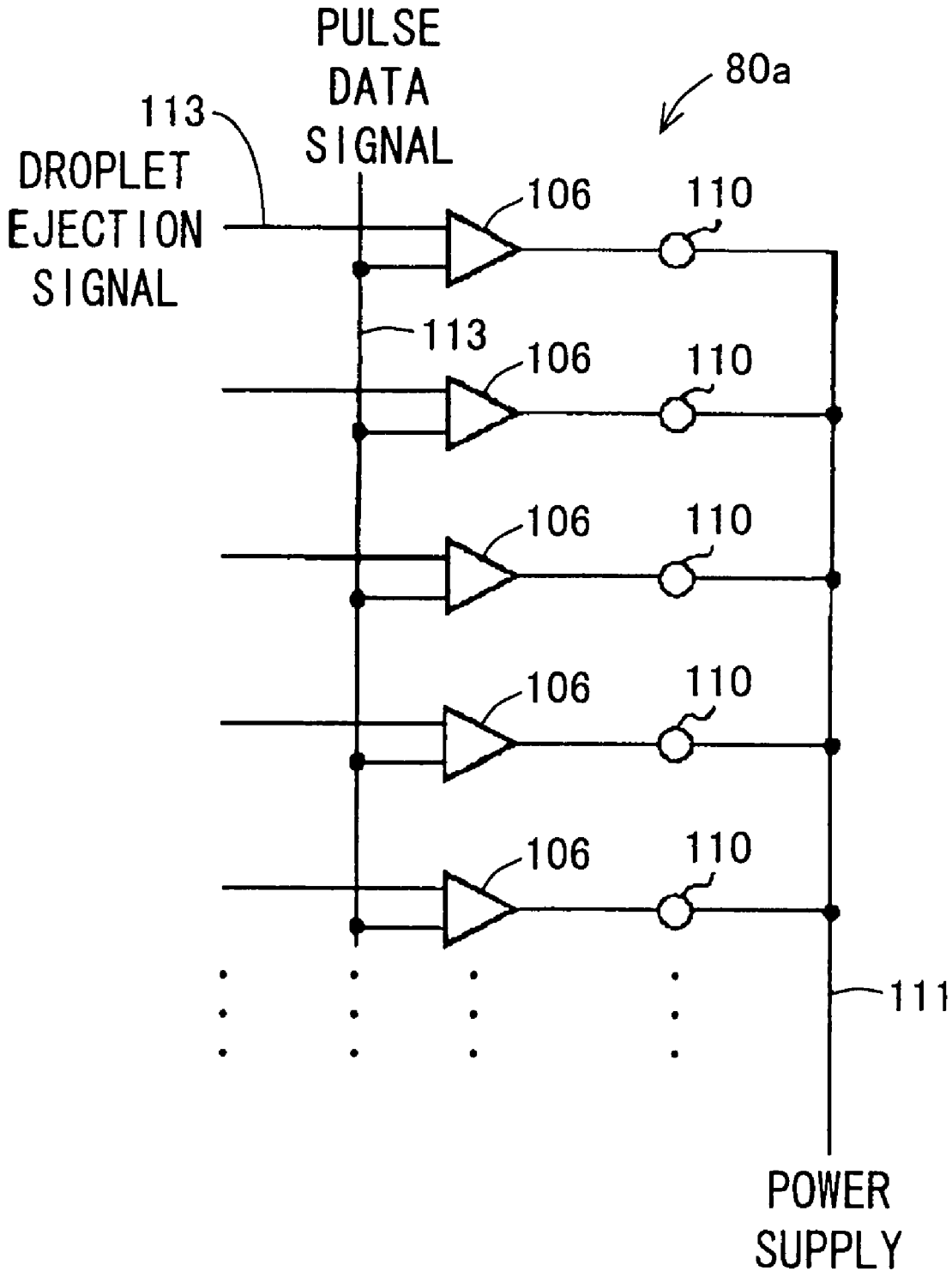
FIG. 6 is a circuit diagram schematically illustrating a configuration of a droplet ejection system for an ink jet head.

FIG. 5 is a block diagram schematically illustrating a configuration of the droplet ejection control of the fixing fluid 9 by the fixing fluid amount controlling section shown in FIG. 4. FIG. 6 is a circuit diagram schematically illustrating a configuration of a droplet ejection system for an ink jet head 80*a*. The CPU 101 controls a head driver 106 and a motor driver 107 on the basis of the print data temporarily stored in the RAM 103. The head driver 106 is included in the droplet ejection system and controls ejection of the droplet of the fixing fluid 9 from the fixing fluid spray nozzles of the ink jet head 80*a*. The droplet ejection system for the ink jet head 80*a* includes the ink jet head, the head driver 106, and signal line 113. The ink jet head 80*a* includes a piezoelectric element 110 and a wire 111. The piezoelectric element 110 is provided in the vicinity of every fixing fluid spray nozzle of the ink jet head 80*a* and generates electric-mechanic conversion energy to eject the fixing fluid 9. One end of the piezoelectric element 110 is connected to the wire 111 and the other end thereof is connected to the head driver 106. The wire 111 electrically connects the piezoelectric elements 110 to the power supply and thus driving power is supplied from the power supply to the piezoelectric element 110.

The droplet ejection signal from the CPU 101 as a pulse data signal is inputted to the head driver 106 through the signal line 113. The droplet ejection signal is a signal for ejecting the fixing fluid according to each dot of pixels at a predetermined time while the ink jet head 80*a* performs the ejecting operation. A value "1" of this signal denotes ejection of a droplet and a value "0" denotes non-ejection of a droplet. The droplet ejection signal "1" is converted to a pulse signal "1" and the droplet ejection signal "0" corresponds to a pulse signal "0". The pulse signal is a signal corresponding to the two-value processed print data (Y0, M0, C0) and (Y1, M1, C1). When this signal is "1", the head driver 106 applies pulse to the piezoelectric element 110 and the piezoelectric element 110 is driven to eject droplets of the fixing fluid 9. Meanwhile, the motor driver 107 receives a control signal from the CPU 101 and controls a carriage motor 108 to rotate. The carriage motor 108 drives a carriage 109 by the rotation thereof. The carriage 109 reciprocates the ink jet head 80*a* in a direction perpendicular to the conveying direction of the recording medium. That is, the CPU 101 controls the reciprocating scanning in the direction perpendicular to the conveying direction of the recording medium of the carriage 109 and further the ink jet head 80*a* supported to the carriage 109 through the motor driver 107 by using the carriage motor 108 as a driving source.

Figure 7:
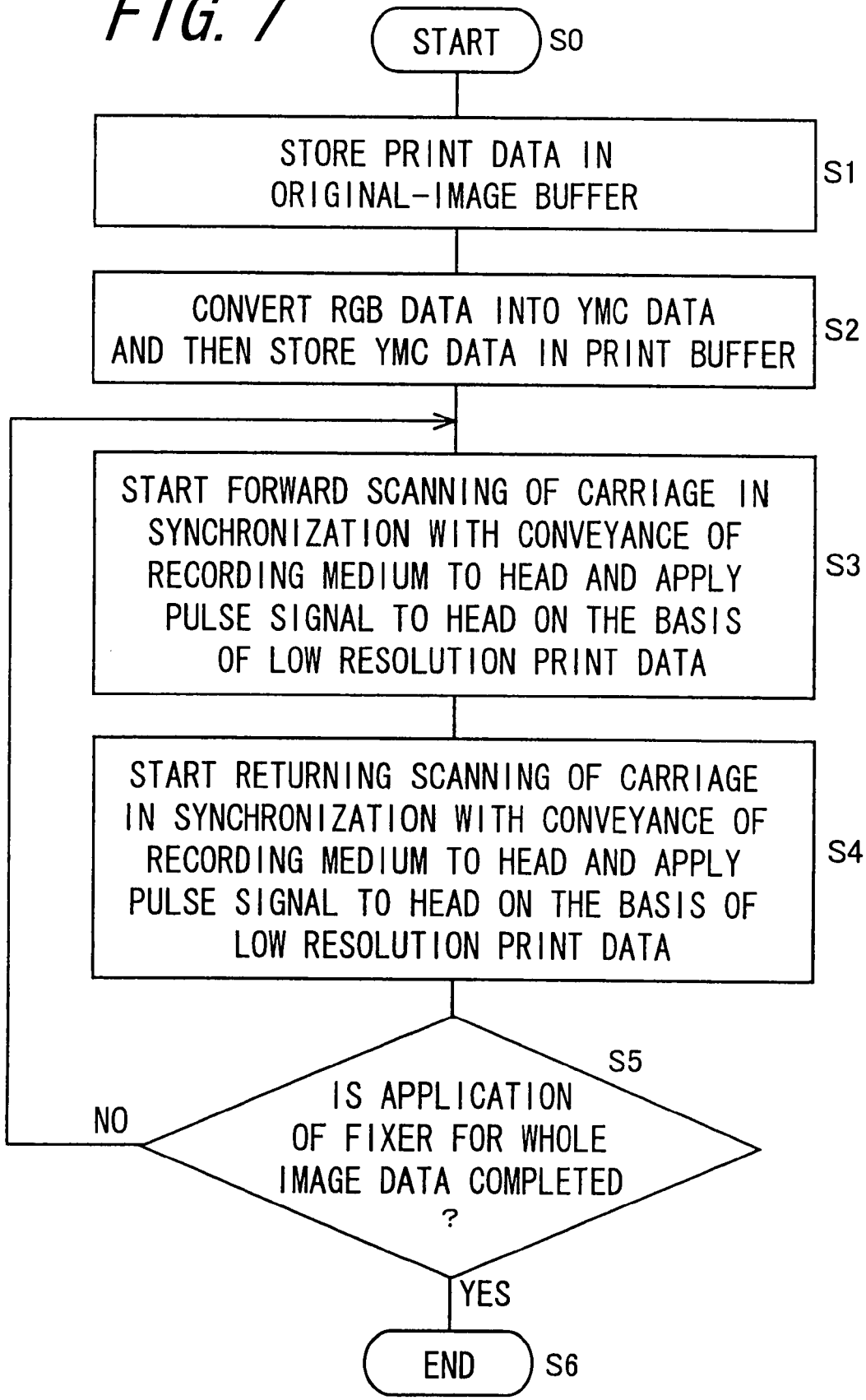
FIG. 7 is a flowchart illustrating control operation by the fixing fluid amount controlling section.
Figure 8:
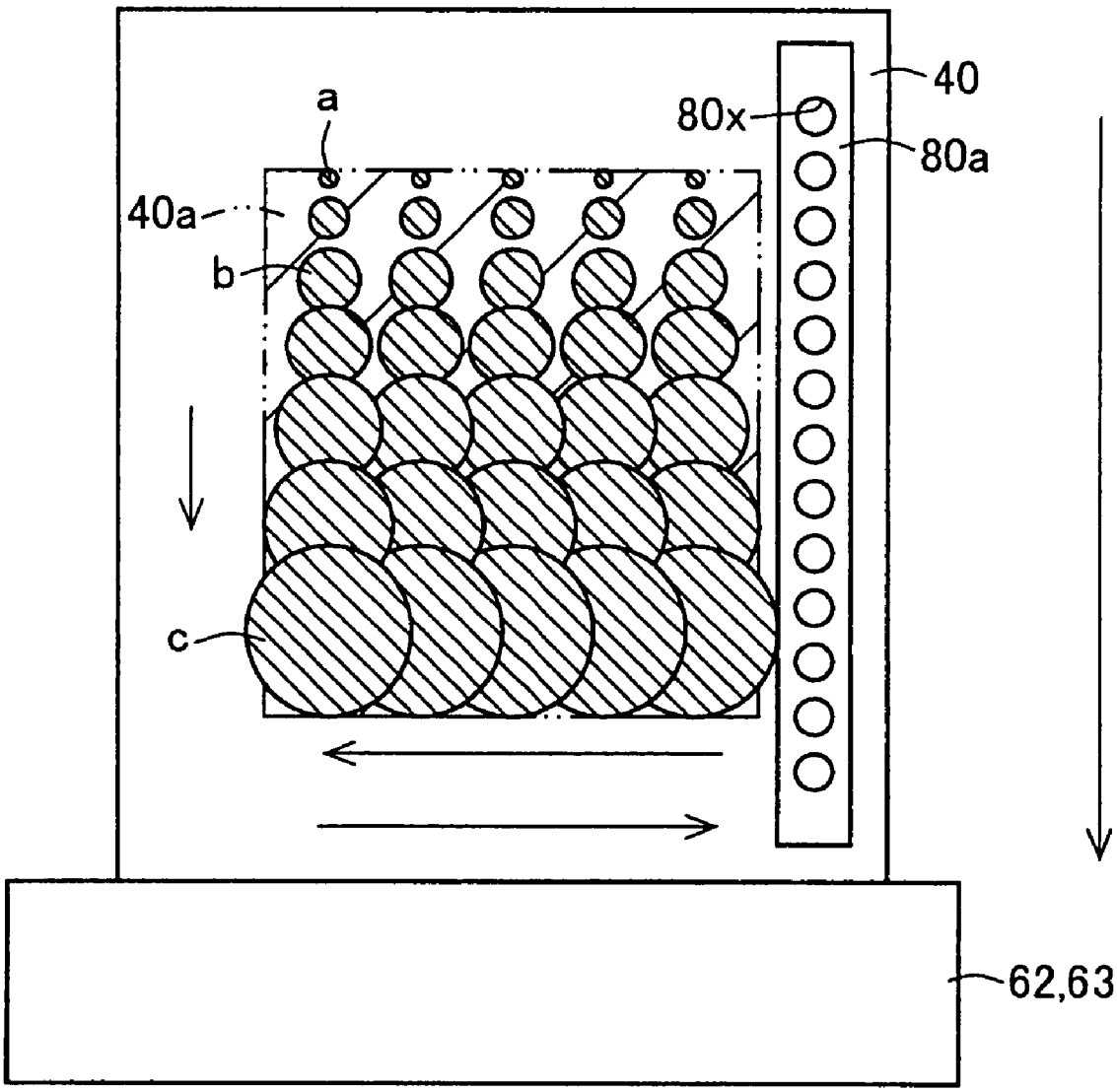
FIG. 8 is a plan view illustrating an ejection state of the fixing fluid to the recording medium.

FIG. 7 is a flowchart illustrating control operation by the fixing fluid amount controlling section. FIG. 8 is a plan view illustrating an ejection state of the fixing fluid 9 to the recording medium 40. A start in step S0, for example, presents a state that image information made from a personal computer and the like is applied to the image forming apparatus 1. In step S1, the image information applied to the image forming apparatus 1 is inputted to the CPU 101 and is temporarily stored in the original-image buffer 104 of the RAM 103 as 8 bit 256 tone signals for the R (red), G (green), and B (blue). In step S2, color conversion and multicolor process is performed on 8 bit 256 tone signals for the R (red), G (green), and B (blue) temporarily stored in the original-image buffer 104 and the signals is data presenting existence or nonexistence of dots on each Y, M, and C. The data is converted to dot nonexistence (Y0, M0, C0), dot existence (Y1, M1, C1) and two-processed YMC data and is temporarily stored in the print buffer 105.

In step S3, in synchronization with time when the recording medium 40 having the toner image transferred thereto is conveyed at a predetermined position under a vertical direction of the ink jet head 80*a*, the fixing fluid 9 is supplied from the fixing fluid spray nozzle 80*x* to each pixel on the basis of the print data stored in the print buffer 105 while the CPU 101 performs a forward scanning to the carriage 109. Since the pitch of the fixing fluid spray nozzles 80*x* of the ink jet head 80*a* is set be lower than that of the original image, the print data is obtained by removing pixels from the original image by downsampling. Practically, since the resolution of the original image is 600 dpi, the pitch of the fixing fluid spray nozzles 80*x* of the ink jet head 80*a* is 75 dpi, the print data in which the original image data size is reduced to ⅛ by downsampling is inputted to the ink jet head 80*a* as a signal. A pulse signal with a width based on the print data is applied to the piezoelectric element 110 corresponding to pixels regulated in this print data and a small dot a is formed in a print area (toner image forming area) 40*a* of the recording medium 40 shown in FIG. 8. In the print area 40*a* of FIG. 8, all pixels show print data of three-color (Y1, M1, C1) solid image. In this case, substantially three times amount of the fixing fluid 9 should be applied in comparison with one solid image per one pixel. The fixing fluid amount supplied from the fixing fluid spray nozzles 80*x* per one time, for example, may be controlled by adjusting a period of the pulse signal applied to the piezoelectric element 110.

In step S4, in a returning scanning of the carriage 109 and further the ink jet head 80*a*, the fixing fluid 9 is supplied from the fixing fluid spray nozzle 80*x* corresponding to the pixel having the print data. A middle dot b in the print area 40*a* of the recording medium 40 shown in FIG. 8 is a dot in which an outer diameter thereof is enlarged by re-supplying the fixing fluid 9 onto the small dot a formed by supplying the fixing fluid 9 in the course of the forward scanning. In step S5, the CPU 101 judges whether all print data is processed or not. When it is judged that all print data have been processed, it is completed to apply the fixing fluid 9 and processing ends in step S6. When it is judged that all print data have not been processed, processing returns to step S3. Then, step S3 and step S4 are repeatedly performed until it is judged that all print data have been processed. A large dot c in the print area 40*a* of the recording medium 40 shown in FIG. 8 presents a state that the greatest amount of fixing fluid 9 is applied. The fixing fluid 9 is applied on the basis of the print data of each pixel stored in the print buffer 105. Accordingly, as shown in FIG. 8, the applying amount of the fixing fluid 9 can decrease in a side apart from the fixing nip portion and the applying amount of the fixing fluid 9 can increase as it approaches the fixing nip portion. In addition, since the fixing fluid is applied on the basis of the print data obtained from the image information, substantially three times amount of the fixing fluid 9 is supplied, for example, to a pixel position where print data of each color like print data (Y1, M1, C1) is overlaid in comparison with a pixel position of print data of any one color of Y, M, or C. Since the proper amount of the fixing fluid 9 can be applied on the basis of the toner attachment amount of the pixel, it is prevented that the toner 8 is insufficiently swelled and softened due to a short of the applying amount of the fixing fluid 9.

A control unit 120 is provided in the image forming apparatus 1. The control unit 120, for example, is a processing circuit which is provided in the upper portion inside the image forming apparatus 1, which includes a control section, a calculation section, and a storage section which are not shown, and which is realized by a microcomputer and the like. An image forming command through a manipulation panel (not shown) disposed on the upper surface of the image forming apparatus 1, a sensed result from a sensor and (not shown) and the like disposed in each part inside the image forming apparatus 1, and image information from an external device, and the like are inputted to the storage section of the control unit 120. The calculation section performs judgment on the basis of the input data (image forming command, sensed result, image information, and the like) and a control signal is sent from the control section on the basis of the judged result, whereby the whole operation of the image forming apparatus 1 is controlled by the control unit 120. For example, a read only memory (ROM), a random access memory (RAM), a hard disk drive (HDD), and the like generally used in this field may be used as the storage section. An electric and electronic device which can be electrically connected to the image forming apparatus may be used, for example, a computer, a digital camera, a television, a video recorder, a DVD recorder, a facsimile, and the like. The control unit 120 includes a power supply together with the process circuit and the power supply supplies power to each device inside the image forming apparatus 1 as well as to the control unit 120.

According to the image apparatus 1, the multicolored toner image formed on the intermediate transfer belt 21 by the toner image forming section 2 is transferred onto the recording medium 40 in the transfer nip portion, the fixing fluid 9 supplied from the droplet supplying section 80 to the recording medium 40 is applied to the multicolored toner image of the recording medium 40, the multicolored toner image is fixed onto the recording medium 40, and thus the image is formed. In the image forming apparatus 1, when the toner image is fixed to the recording medium 40 using the fixing fluid 9, it is controlled that the applying amount of the fixing fluid 9 increases as approaching the fixing nip portion. Accordingly, even when the fixing fluid applying section and the heating section are used together, the high-quality image can be stably formed without scattering and a bad image. Since the applying amount can be controlled to be sufficient for swelling and softening the toner 8, curl or creases, and the like does not occur on the recording medium 40. Even when the heating section is used together, the control is not required at a high temperature (140° C. or more) like the known art and the toner image can be fixed by a temperature control at about 80° C. Accordingly, energy can be extremely saved and power consumption can decrease. By using both the heating section and the fixing fluid amount controlling section together, even when the fixing fluid 9 a little remains after swelling and softening the toner, the fixing fluid 9 is volatilized in a short time. Accordingly, the recording medium 40 becomes rapidly dry and stack performance is good without adhesion in case of overlaying the image after fixation. Consequently, a throughput which indicates output per unit time is enhanced. The image forming apparatus 1 presents the sufficient stack performance. When the process speed of the image forming apparatus 1 is further improved and quick-drying of the fixing fluid 9 is required, the heating section may be provided inside the first pressing roller 62 and/or the second pressing roller 63.

Figure 9:
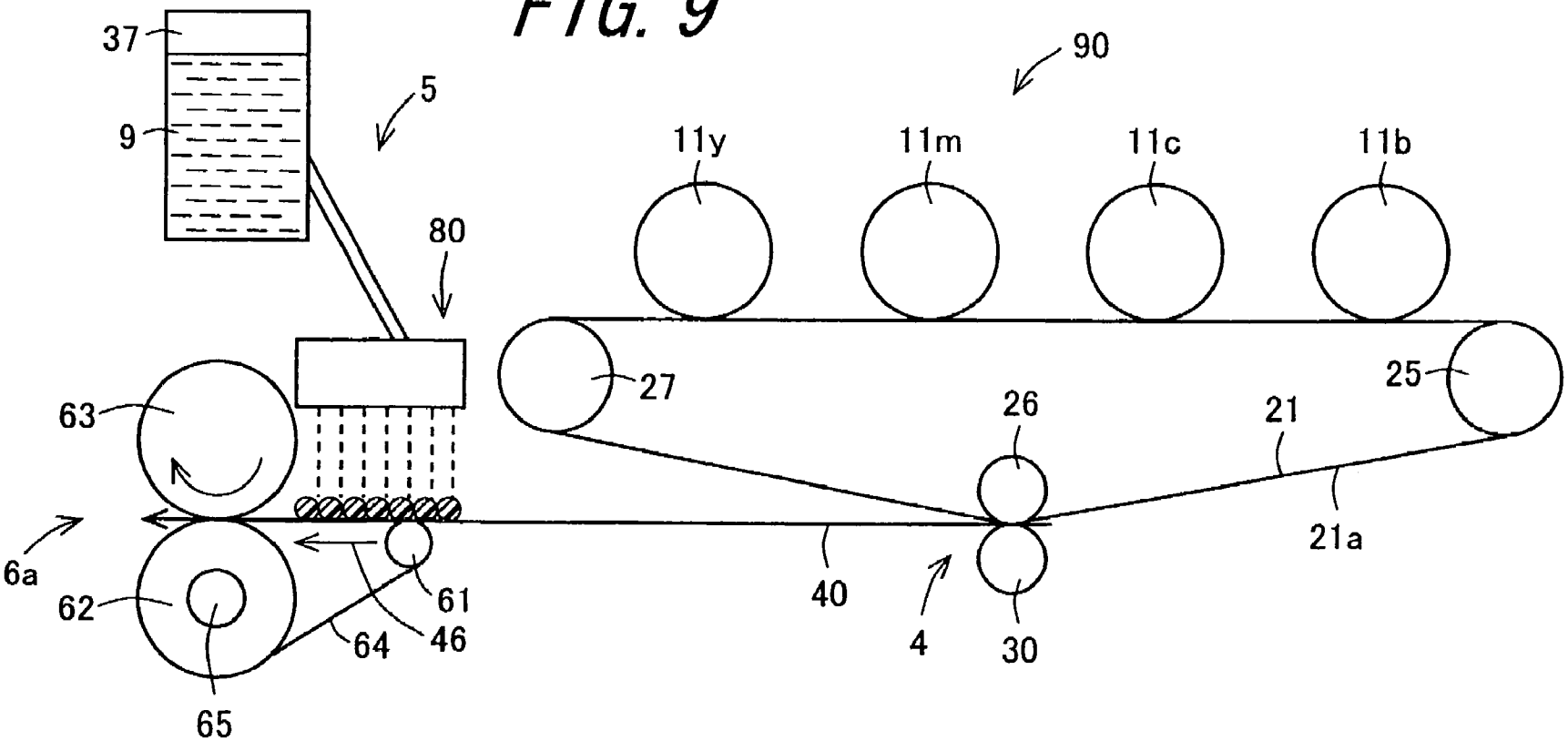
FIG. 9 is a sectional view schematically illustrating a configuration of essential portions of an image forming apparatus according to a second embodiment of the invention.

FIG. 9 is a sectional view schematically illustrating a configuration of essential portions of an image forming apparatus 90 according to a second embodiment of the invention. The image forming apparatus 90 shown in FIG. 9 is similar to the image forming apparatus 1. Accordingly, the corresponding parts are indicated by the same reference numerals and the description or the illustration is omitted. The image forming apparatus 90 has the same configuration as the image forming apparatus 1 except that a heating section 65 is provided in a first pressing roller 62 and the heating section 65 is not provided in a driving roller 61. A recording medium conveyer belt 64 is heated by the heating section 65 provided inside the first pressing roller 62. A recording medium 40 which is placed on the recording medium conveyer belt 64 and which has a toner image transferred thereto is heated by the conveyer belt 40. Since a fixing fluid 9 is applied to the toner image on the recording medium 40 by a fixing fluid applying section 5 and the toner image is heated by the recording medium conveyer belt 64 at the same time, bleeding and aggregation of the toner 8 due to application of the fixing fluid 9 does not occur. According to the image forming apparatus 90, in a transfer nip portion of a secondary transfer section 4, the fixing fluid 9 is applied to the toner image transferred to the recording medium 40 by a fixing fluid applying section 5 in the course of transferring the recording medium 40 to a fixing nip portion of a fixing section 6*a*, the toner constituting the toner image is swelled and softened by the fixing fluid 9, is heated and pressed in the fixing nip portion, the toner image is fixed to the recording medium 40, the image is formed, and the remaining fixing fluid 9 is volatilized. In the embodiment, a temperature sensor (not shown) is provided on the surface of the first pressing roller 62 and the temperature control is performed so that the surface temperature of the first pressing roller 62 is kept in the range of 80 to 100° C. on the basis of the result sensed by the temperature sensor.

Figure 10:
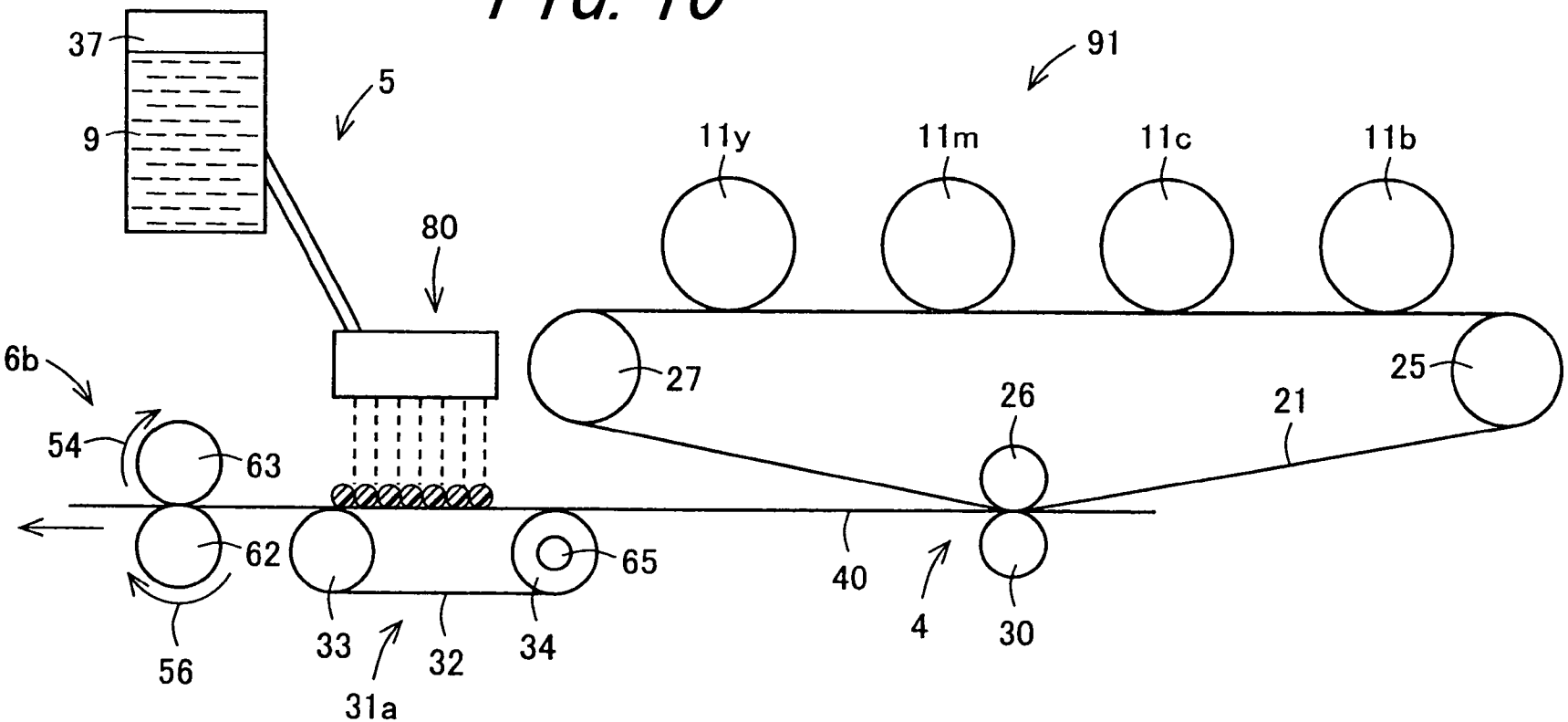
FIG. 10 is a sectional view schematically illustrating a configuration of essential portions of an image forming apparatus according to a third embodiment of the invention.

FIG. 10 is a sectional view schematically illustrating a configuration of essential portions of an image forming apparatus 91 according to a third embodiment of the invention. The image forming apparatus 91 shown in FIG. 10 is similar to the image forming apparatus 1. Accordingly, the corresponding parts are indicated by the same reference numerals and the description or the illustration is omitted. In the image forming apparatus 91, a conveying section 31*a* in which a heating section 65 is provided inside a tension roller 34 34 in the conveying section 31 of the image forming apparatus 1 is provided, a fixing fluid 9 is applied to a toner image on a recording medium 40 placed on the conveying section 31*a* by a fixing fluid applying section 5, and a fixing section 6*b* including a first pressing roller 62 and second pressing roller 63 is provided instead of the fixing section 6 of the image forming apparatus 1. In a transfer nip portion of the secondary transfer section 4, while the recording medium 40 having the toner image transferred thereto is placed on a conveyer belt 32 of the conveying section 31*a* and transferred to the fixing nip portion of the fixing section 6*b*, the recording medium is heated by the heating section 65 built in a tension roller 34 and a fixing fluid is applied thereto by a fixing fluid 9 applying section 5. Accordingly, the toner 8 is swelled and softened without bleeding and aggregation of the toner 8 constituting the toner image. The recording medium 40 is transferred to the fixing nip portion and is pressed with the toner 8 swelled and softened, whereby the toner image is fixed to the recording medium 40. The invention may be embodied in other specific forms without departing from the spirit or essential characteristics thereof.

The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a toner image forming section which forms a toner image according to image information;

a transfer section which transfers the toner image on a recording medium formed by the toner image forming section;

a fixing section which fixes the toner image transferred on the recording medium by the transfer section;

a conveying section which conveys the recording medium on which the toner image is transferred from the transfer section to the fixing section;

a fixing fluid applying section which is placed between the transfer section and the fixing section and applies to the toner image on the recording medium a fixing fluid which softens and/or swells a toner, after the toner image is transferred on the recording medium by the transfer section, which recording medium is conveyed to the fixing section by the conveying section; and a fixing fluid amount controlling section which controls an amount of the fixing fluid applied to the toner image on the recording medium by the fixing fluid applying section so as to increase as the recording medium approaches the fixing section.

2. The image forming apparatus of claim 1, wherein the fixing fluid applying section includes:

a fixing fluid reservoir which stores the fixing fluid therein;

a droplet supplying section having fixing fluid spray nozzles from which the fixing fluid is supplied to the toner image on the recording medium; and a supply tube through which the fixing fluid in the fixing fluid reservoir is supplied to the droplet supplying section.

3. The image forming apparatus of claim 2, wherein a spray nozzle pitch is lower than an image resolution of the toner image forming section.

4. The image forming apparatus of claim 3, wherein the spray nozzle pitch is 150 dpi or less.

5. The image forming apparatus of claim 1, wherein the fixing fluid amount controlling section controls the amount of the fixing fluid applied from the fixing fluid applying section to the toner image on the recording medium according to the image information.

6. The image forming apparatus of claim 1, further comprising:

a heating section for heating the recording medium on which the toner image is transferred, the heating section being provided upstream of a position of applying the fixing fluid to the toner image on the recording medium by the fixing fluid applying section in a direction of conveying the recording medium on which the toner image is transferred by the conveying section.

7. The image forming apparatus of claim 1, wherein the fixing section includes:

a driving roller;

a pressing roller;

a conveyer belt tightly suspended by the driving roller and the pressing roller and which is formed in a loop shape, for conveying the recording medium on which the toner image is transferred; and a heating section provided inside the driving roller and/or the pressing roller.

* * * * *